US006099608A

United States Patent [19]

Harms et al.

[11] Patent Number: 6,099,608

[45] Date of Patent: Aug. 8, 2000

[54] ROTATING FILTRATION CARTRIDGE AND BLOWER FOR HVAC APPLICATIONS

[75] Inventors: Michael Harms, Woodbury; Yuan-Ming Tang, New Brighton; Ricardo Lira, Woodbury, all of Minn.; James R. Larson, Roberts, Wis.

[73] Assignee: 3M Innovative Properties Company, St. Paul, Minn.

[21] Appl. No.: 09/126,189

[22] Filed: Jul. 30, 1998

[51] Int. Cl.[7] ..... B01D 25/00; B01D 33/37; B01D 33/00

[52] U.S. Cl. ..... 55/400; 55/471; 55/473; 55/484; 55/495; 55/498; 55/505; 55/DIG. 39

[58] Field of Search ..... 55/400, 406, 408, 55/467, 471, 473, 309, 484, DIG. 39, 498, 495, 505; 210/488, 491; 95/277

[56] References Cited

U.S. PATENT DOCUMENTS

| | | | |
|---|---|---|---|
| Re. 30,782 | 10/1981 | van Turnhout | 264/22 |
| 2,272,746 | 2/1942 | Holm-Hansen | 183/4 |
| 3,123,286 | 3/1964 | Abbott | 230/134 |
| 3,126,263 | 3/1964 | Schwab | 55/317 |
| 3,392,512 | 7/1968 | Ziolko et al. | 55/400 |
| 3,402,881 | 9/1968 | Moore et al. | 230/232 |
| 3,590,629 | 7/1971 | Courbon | 73/28 |
| 3,676,985 | 7/1972 | Foreman et al. | 55/317 |
| 3,765,155 | 10/1973 | Courbon | 55/270 |
| 3,877,905 | 4/1975 | Novak | 55/404 |
| 3,877,906 | 4/1975 | Peterson | 55/404 |
| 3,898,066 | 8/1975 | Miskiewicz | 55/317 |
| 3,931,016 | 1/1976 | Lovelady | 210/297 |
| 3,993,564 | 11/1976 | Novak | 210/360 |
| 4,038,058 | 7/1977 | Miskiewicz | 55/317 |
| 4,071,336 | 1/1978 | Yamine | 55/203 |
| 4,266,829 | 5/1981 | Divers | 299/64 |
| 4,292,055 | 9/1981 | De Castella et al. | 55/233 |
| 4,308,041 | 12/1981 | Ellis et al. | 55/510 |
| 4,411,675 | 10/1983 | de Castella | 55/316 |
| 4,422,824 | 12/1983 | Eisenhardt, Jr. | 416/5 |
| 4,450,756 | 5/1984 | Kling | 98/115 |
| 4,469,084 | 9/1984 | Gillotti | 126/96 |
| 4,534,230 | 8/1985 | Courbon | 78/863.23 |

(List continued on next page.)

FOREIGN PATENT DOCUMENTS

| | | | |
|---|---|---|---|
| 0 117 084A | 8/1984 | European Pat. Off. . | |
| 0 196 337 A1 | 3/1985 | European Pat. Off. . | |
| 0 306 278 A1 | 3/1989 | European Pat. Off. . | |
| 0 810 023 A1 | 12/1997 | European Pat. Off. . | |
| 22 19 846 | 10/1973 | Germany | 55/472 |
| 60-029940 | 2/1985 | Japan . | |
| 11-90146 | 9/1997 | Japan . | |
| 1037 365 | 7/1966 | United Kingdom | 55/400 |
| 2223187 | 4/1990 | United Kingdom | 55/400 |
| WO 91/11246 | 8/1991 | WIPO . | |
| WO 97/44624 | 11/1997 | WIPO . | |

OTHER PUBLICATIONS

American National Standard Method for Measuring Performance of Portable Household Electric Cord–Connected Room Air Cleaners, ANSI/AHAM AC–1–1988, Association of Home Appliance Manufacturers, 24 pages.

*Primary Examiner*—David A. Simmons
*Assistant Examiner*—Robert A. Hopkins
*Attorney, Agent, or Firm*—Gary L. Griswold; Robert W. Sprague; William J. Bond

[57] ABSTRACT

A filtration system that rotates in conjunction with a blower wheel, and a method of attaching the same. The blower wheel typically has a plurality of fan blades arranged in a spaced relationship radially around a blower cavity to define a flow path extending radially outward from the blower cavity through the fan blades when the blower wheel is rotating. The filtration system includes a filter cartridge releasably attachable to the blower wheel in an engaged configuration. The filter cartridge includes a filter medium defining a generally center opening and a filter surface configured to be positioned generally adjacent to the fan blades and to extend across at least a portion of the flow path. In one embodiment, a plurality of flow passages extending through the filter medium.

29 Claims, 11 Drawing Sheets

U.S. PATENT DOCUMENTS

| | | | |
|---|---|---|---|
| 4,547,208 | 10/1985 | Oace | 55/400 |
| 4,595,502 | 6/1986 | Himmelsbach | 210/483 |
| 4,658,707 | 4/1987 | Hawkins et al. | 98/2.11 |
| 4,676,721 | 6/1987 | Hardee | 416/146 |
| 4,753,573 | 6/1988 | McKnight | 416/62 |
| 4,840,650 | 6/1989 | Matherne | 55/385.1 |
| 4,889,543 | 12/1989 | Burt | 55/97 |
| 4,917,942 | 4/1990 | Winters | 428/286 |
| 4,968,425 | 11/1990 | Nakajima et al. | 210/488 |
| 5,057,128 | 10/1991 | Panzica et al. | 55/181 |
| 5,230,800 | 7/1993 | Nelson | 210/496 |
| 5,238,473 | 8/1993 | Femiani | 55/290 |
| 5,256,476 | 10/1993 | Tanaka | 428/241 |
| 5,265,348 | 11/1993 | Fleishman et al. | 34/97 |
| 5,271,838 | 12/1993 | Rahimi et al. | 210/346 |
| 5,292,479 | 3/1994 | Haraga et al. | 422/5 |
| 5,332,426 | 7/1994 | Tang et al. | 96/153 |
| 5,341,565 | 8/1994 | Kuryliw | 29/889.721 |
| 5,370,721 | 12/1994 | Carnahan | 55/279 |
| 5,514,197 | 5/1996 | Den | 55/405 |
| 5,560,835 | 10/1996 | Williams | 210/783 |
| 5,573,563 | 11/1996 | Odom | 55/301 |
| 5,681,364 | 10/1997 | Fortune | 55/400 |
| 5,683,478 | 11/1997 | Anonychuk | 55/385.3 |
| 5,749,702 | 5/1998 | Datta et al. | 415/119 |
| 5,879,230 | 3/1999 | Wardlaw et al. | 454/139 |

ROTATING FILTRATION CARTRIDGE AND BLOWER FOR HVAC APPLICATIONS

FIELD OF THE INVENTION

The present invention relates to a filtration system releasably attachable to a blower wheel in an HVAC system, and in particular, to a filter cartridge having a plurality of flow passages that maintains a high flow rate even when the filter medium is in a fully loaded state.

BACKGROUND OF THE INVENTION

With increased concern over environmental air quality, innovative solutions have been sought for adding filtration capacity to new and existing air circulation systems, such as heating, ventilation, and cooling systems (HVAC) for buildings and vehicles. For example, the HVAC systems in most vehicles do not include air filters. Minimal space is generally available for retrofitting a filter to the HVAC system. Moreover, it may be necessary to provide one filter for incoming air and a second filter for air recirculating within the passenger compartment. Even on new vehicles, space within the HVAC system is at a premium and it is difficult for some manufacturers to provide a location for an appropriate filter.

In addition to the difficulty of finding sufficient space for a filter, the failure mode of most filter media also raises concerns. Over time, environmental contaminants accumulate in filters, typically resulting in a reduced flow rate through the air circulation system. Failure to replace the filter media periodically can result in an increased static air pressure drop across the filter and reduced efficiency for the air circulation system. The reduced flow rate through a loaded filter can also create safety hazards, such as allowing insufficient air flow for operating the defrost system of an HVAC system.

One approach to retrofitting an air filter to an HVAC system of a vehicle is disclosed in U.S. Pat. No. 5,683,478 (Anonychuk). The air filter is sized and shaped to fit into a cavity located within a blower motor assembly. An outwardly extended lip is provided on the base of the air filter for rigid attachment to a rim located below the fan on the automobile. The fan in the blower motor assembly rotates around the stationary filter. Although the '478 patent recognizes the need to provide filtration efficiency without impeding air flow, air flow will inevitably be reduced as the filter becomes loaded with environmental contaminants. The failure mode of the filter element may be an unacceptable reduction in air flow through the blower motor assembly.

U.S. Pat. No. 5,265,348 (Fleishman et al.) discloses the use of a rotating foam material on a rotary fan to reduce noise.

BRIEF SUMMARY OF THE INVENTION

The present invention is directed to a filtration system attachable to a blower wheel in an HVAC system. The filter cartridge releasably attaches to either the outside perimeter or the inside perimeter of the blower wheel. Movement of the filter cartridge with the blower wheel increases filtration efficiency during blower operation. The present moving filter can be retrofitted to most existing blower wheels. Locating the filter cartridge at the blower wheel provides filtration of both outside air entering the HVAC system and air being recirculated within the system. The filter cartridge includes flow passages of a size, density and shape such that a high flow rate is maintained even when the filter media is fully loaded. Some loss of filtration efficiency due the flow passages can be offset by increased efficiency due to the movement of the filter cartridge with the blower wheel.

The present filtration system will reduce the airflow through the blower wheel, thereby reducing the speed and power consumption of the motor. The relationship between power and flow is a cubic function. By reducing the motor speed, the life of the motor is extended. The filter media may include activated carbon or other sorbent materials to remove odors and gases from the air, such as diesel exhaust, car exhaust, urban or farm smells, carbon monoxide, and ozone.

The filtration system rotates in conjunction with a blower wheel. The blower wheel has a plurality of fan blades arranged in a spaced relationship radially around a blower cavity. The blower wheel defines a flow path extending radially outward from the blower cavity and through the fan blades when the blower wheel is rotating. The filtration system includes a filter cartridge releasably attachable to the blower wheel in an engaged configuration. The filter cartridge includes a filter medium defining a generally center opening and a filter surface configured to be positioned adjacent to the fan blades and to extend across at least a portion of the flow path when in the engaged configuration. The filter surface may be located generally adjacent to an inner or an outer surface defined by the fan blades. In one embodiment, the filter medium is off-set from the fan blades, but still extends across a portion of the flow path. The filter medium may optionally include a plurality of flow passages.

The filter medium may be a conventional particulate filter medium, an electret charged medium, carbon particle agglomerates, or combinations thereof. In another embodiment, the filter cartridge includes a plurality of annular filter elements stacked to define the inner and outer filter surfaces. At least one retaining clip retains the annular filter elements in a stacked configuration. In one embodiment, the filter cartridge comprises particulate filtration media having a preferred Frazier permeability of at least 2000 $m^3/hr/m^2$.

The present invention is also directed to an HVAC system or air purifying system including a blower wheel and the present filtration system.

The present invention is also directed to a filter cartridge comprising a plurality of porous, annular filter elements having substantially the same shape stacked concentrically to define an outer filter surface and an inner filter surface. At least one retaining structure maintains the annular filter elements in a stacked and concentric relationship. In one embodiment, a plurality of spacers are positioned between at least two of the annular filter elements. The spacers may be radial pleats, embossed portions in at least one of the annular filter elements, or rib elements adhesively attached to the filter element. The retaining structure may optionally include a mechanism for releasably attaching the filter element to a blower wheel.

The present invention is also directed to a method of attaching a filtration system to a blower wheel. The filter medium of a filter cartridge is configured to define a center opening and the inner and outer filter surfaces. The filter cartridge optionally includes a plurality of flow passages extending through or along the filter medium. The filter cartridge is engaged with the blower wheel so that one of the filter surfaces extend across at least a portion of the flow path adjacent to the fan blades. The filter cartridge is releasably attached to the blower wheel. The filter cartridge may be located adjacent to either the inner surface or the outer surface of the blower wheel.

The method of attaching the filter cartridge to the blower wheel comprises engaging an active fastening system, such as clips, hook and loop fasteners, retaining tabs, mechanical fasteners, adhesives, frictional forces, or an interference fit. In one embodiment, the filter medium of a filter cartridge is configured by stacking a plurality of annular filter elements in a retaining structure to define the filter surface. The method of attaching the filter cartridge to the blower wheel comprises attaching the retaining structure to the blower wheel.

DETAILED DESCRIPTION OF THE INVENTION

Figure 1:
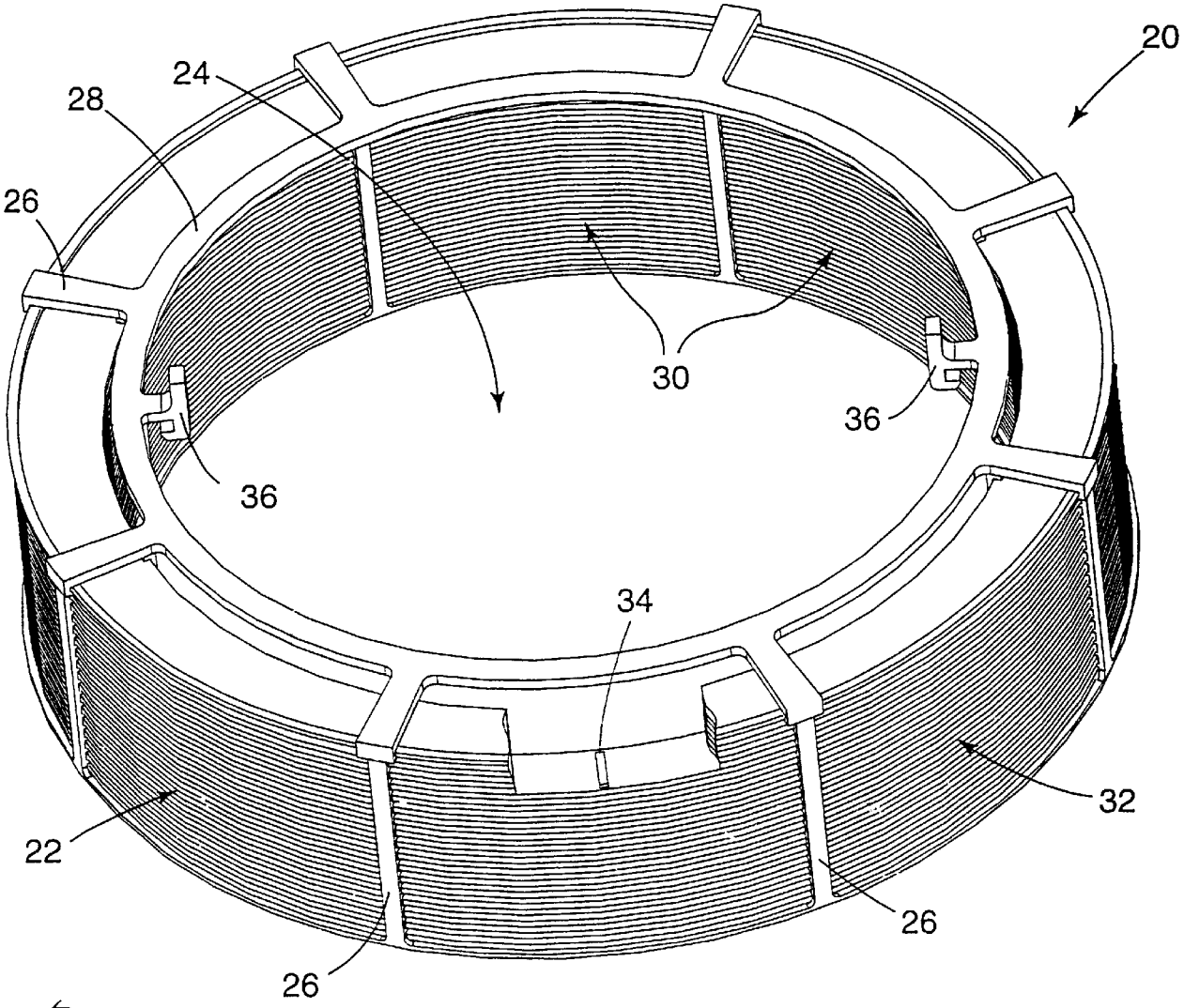
FIG. 1 is a perspective view of a filter cartridge in accordance with the present invention.
Figure 1A:
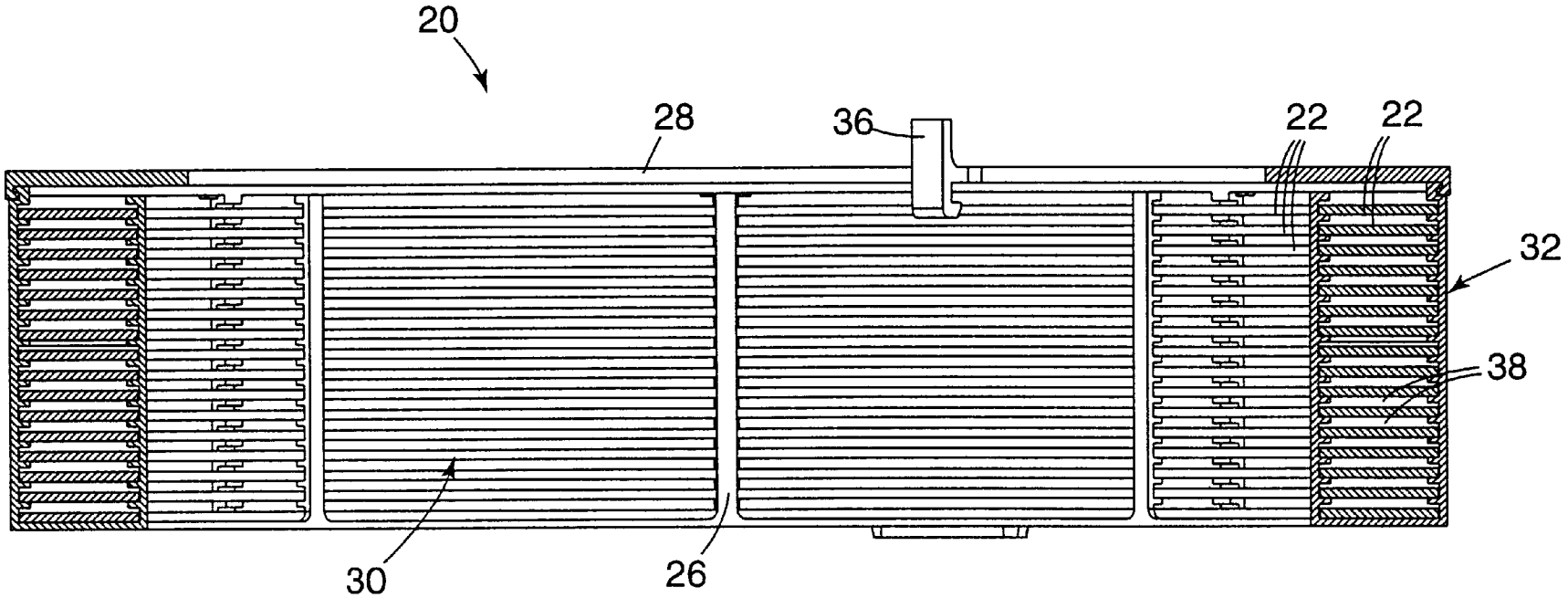
FIG. 1A is a sectional view of the filter cartridge of FIG. 1.

FIGS. 1 and 1A illustrate a filter cartridge 20 in accordance with the present invention. The filter cartridge 20 includes a plurality of annular filter media 22 arranged in a stack to form a generally center opening 24. An inner filter surface 30 is defined by the cylindrical surface located along the center opening 24. An outer filter surface 32 is defined by the outer cylindrical surface of the annular filter media 22.

In the illustrated embodiment, the annular filter media 22 are retained generally concentrically in the cylindrical configuration by a plurality of retaining straps 26 extending around the stack of annular filter media 22. The retaining straps 26 preferably having a shape corresponding to a cross section of the stack of concentrically arranged annular filter media 22. The retaining straps 26 are preferably attached to an inner support member 28. In an alternate embodiment, the retaining straps 26 extend only part of the way around the stack of annular filter media 22.

Spacers 34 may optionally be located between two or more of the annular filter elements 22. The spacers 34 maintain flow passages 38 through the filter cartridge 20, even when the annular filter elements 22 are fully loaded with particles. Alternatively, at least one of the annular filter elements 22 is embossed or pleated to form the flow passages 38. In one embodiment, the retaining straps 26 form an opening larger than the thickness of the stack of annular filter media 22. Air flowing through the filter cartridge 20 may cause some or all of the individual annular filter media 22 to separate, forming flow passages 38.

The filter cartridge 20 may be used as a conventional in-line filter for an HVAC system, such as disclosed in U.S. Pat. No. 5,683,478 (Anonychuk). Alternatively, the filter cartridge 20 may be attached to a blower wheel 40 (see FIG. 2). Blower wheel refers generically to any squirrel cage rotors, centrifugal rotors and the like. Either the inner or the outer filter surfaces 30, 32 can be positioned adjacent to the blower wheel 40. In the embodiment illustrated in FIG. 1, clips 36 are located adjacent to the inner filter surface 30 for attaching the filter cartridge 20 to the outer surface of a blower wheel. The clips 36 may be configured so that the annular filter media 22 abut or contact the blower wheel 40. Alternatively, the annular filter media 22 may be retained in a spaced-apart or off-set configuration from the blower wheel 40.

Figure 1B:
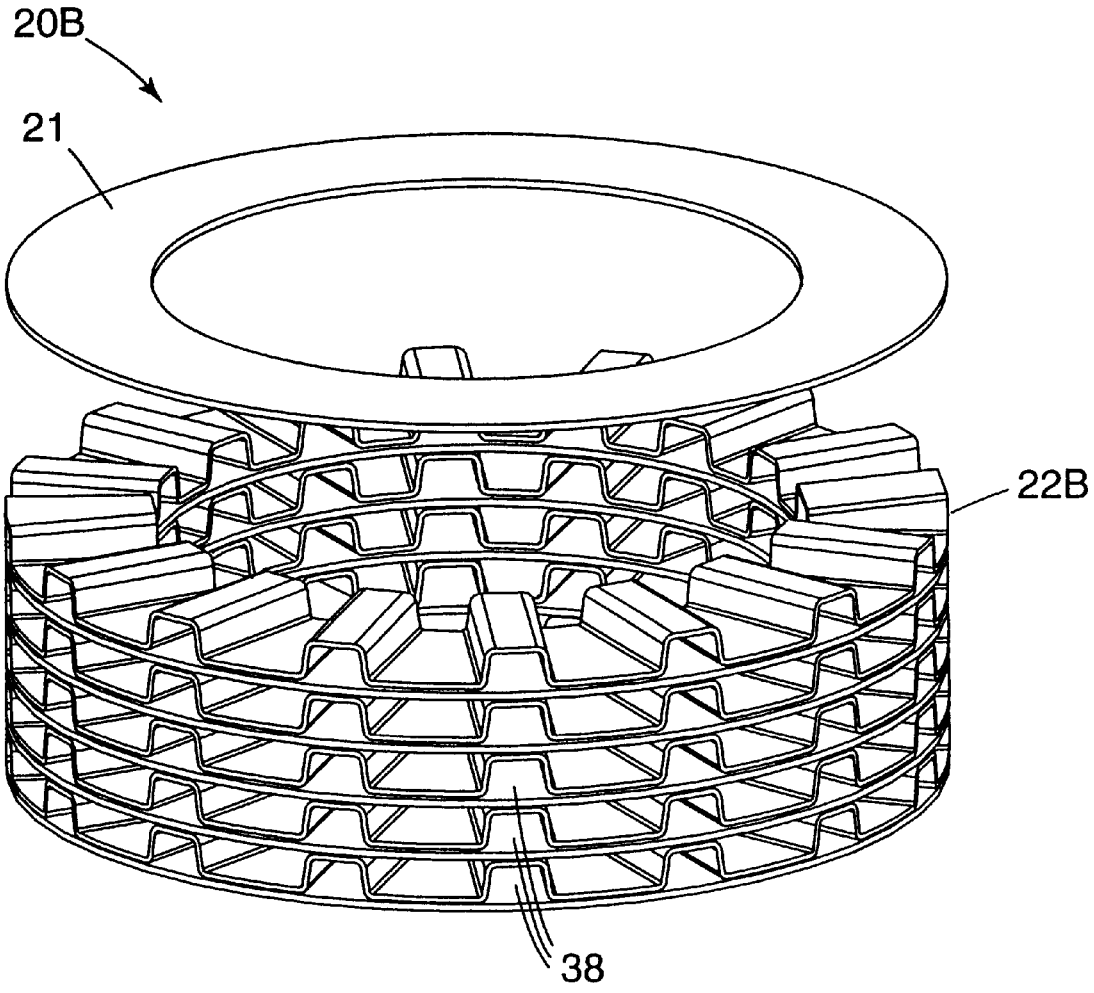
FIG. 1B is an alternate filter cartridge in accordance with the present invention.

FIG. 1B illustrates an alternate filter cartridge 20B in which the annular filter media 22B are embossed to form the flow passages 38. In the embodiment illustrated in FIG. 1B, the annular filter media 22B comprises molded carbon particle agglomerates, such as disclosed in U.S. Pat. No. 5,332,426 (Tang, et al.). A particulate media 21 is optionally positioned between each of the annular filter media 22B.

The annular filter media 22 preferably has sufficient permeability to maintain a high flow rate even when fully loaded. Permeability is measured according to Federal Test Method Standard 191A. Generally, the particulate filter media has a Frazier permeability of at least about 2000 $m^3/hr/m^2$, and preferably for particular filter media at least 2000 $m^3/hr/m^2$ to about 8000 $m^3/hr/m^2$ and from 2000 to 16000 $m^3/h/m^2$ for sorbent filter media. The basis weight of the filter media is generally about 10 to 200 $g/m^2$. If higher filtration efficiency is required, multiple layers of filter media may be used.

Figure 2:
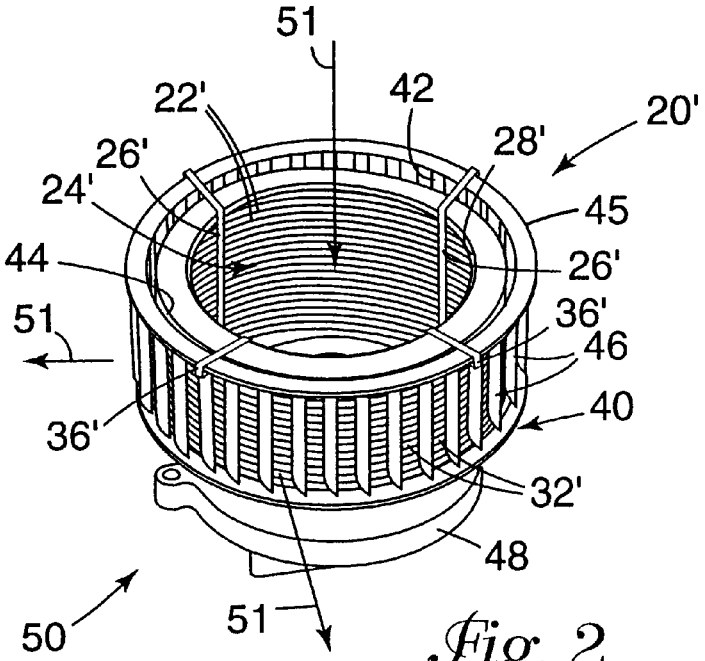
FIG. 2 illustrates the filter cartridge of FIG. 1 engaged with a blower wheel.

FIG. 2 is a perspective view of the filter cartridge 20' generally according to FIG. 1 engaged with a blower wheel 40 of blower system 50. All of the variations discussed herein my be applied to the embodiments of FIGS. 1 and 2. In the illustrated embodiment, the filter cartridge 20' is located within blower cavity 42, so that the outer filter surface 32' is located adjacent to an inside edge 44 of the fan blades 46. The clips 36' are positioned near the outer filter surface 32' to attached the filter cartridge 20' to the inner edge 44 of the blower wheel 40. Alternatively, the filter cartridge 20 of FIG. 1 may be positioned to engage with an outer surface 45 of blower wheel 40 as shown in FIG. 2.

The filter cartridges 20, 20' may have a height less than, greater than, or equal to the height of the blower wheel 40. In an embodiment where the filter cartridges 20, 20' have a height less than the height of the blower wheel, the gap defines a flow passage that permits a portion of the air flowing through the blower system 50 to bypass the filter cartridges 20, 20'.

The filter cartridges 20, 20' may be retained to the blower wheel 40 by a variety of active fastening techniques including adhesives or mechanical fasteners, such as clips, hook and loop fasteners, and/or retaining tabs. In the embodiments illustrated in FIGS. 1 and 2, the clips 36, 36' are integrally formed with the retaining straps 26. Suitable adhesives include pressure sensitive adhesives, thermosetting or thermoplastic adhesives, radiation cured adhesives, adhesives activated by solvents, and combinations thereof. The filter cartridge may also be retained to the blower wheel by frictional engagement or an interference fit with the blower wheel 40. In one embodiment, frictional forces are generated by the filter cartridge 20' having an outer diameter slightly larger than the diameter of the blower cavity 42. In another embodiment, the filter cartridge 20 has a center opening 24 with a diameter slightly smaller than the outer diameter of the blower wheel 40. The compressive forces may deform the annular filter media 22, 22' and/or the retaining straps 26, 26' when engaged with a blower wheel.

As illustrated in FIG. 2, as the motor 48 rotates the blower wheel 40 and the attached filter cartridge 20', the fan blades 46 generate a reduced pressure condition that draws air axially into the center opening 24' and the blower cavity 42 along a flow path 51. The pressure differential draws air through the filter cartridge 20', and ejects it radially out through the fan blades 46 along the path 51. As discussed above, the retaining straps 26' may optionally define an opening larger than the thickness of the stack of annular filter media 22'. When the filter cartridge 20' is rotated with the blower wheel 40, the air flow separates the annular filter media 22' within the confines of the retaining straps 26'.

The filter medium is preferably a material having a useful level of resistance to penetration or transfer of particles and/or aerosols while retaining a desirable level of gas transport through the material. Resistance to permeation or transfer of particles and/or aerosols may be measured by determining the retention (filtration) of particles and can be expressed as clean air delivery rate (CADR), as defined in ANSI Standard AC-1-1988.

The filter media may be paper, porous films of thermoplastic or thermoset materials, nonwoven webs of synthetic or natural fibers, scrims, woven or knitted materials, foams, or electret or electrostatically charged materials. The filter media may also include sorbents such as activated carbon (granules, fibers, fabric, molded shapes) or catalysts. Electret filter webs can be formed of the split fibrillated charged fibers as described in U.S. Pat. No. 30,782. These charged fibers can be formed into a nonwoven web by conventional means and optionally joined to a supporting scrim such as disclosed in U.S. Pat. No. 5,230,800 forming an outer support layer. The support scrim can be a spunbond web, a netting, a Claf web, or the like. Alternatively, the nonwoven fibrous filter web can be a melt blown microfiber nonwoven web, such as disclosed in U.S. Pat. No. 4,917,942 which can be joined to a support layer during web formation as disclosed in that patent, or subsequently joined to a support web in any conventional manner.

Environmental particles are relatively small and discrete entities, either solid, liquid or some combination thereof, typically suspended or carried in the environmental gas flow. The particles may be in the range of about 1.0 mm or more in diameter to less than about 0.01 $\mu$m in diameter. Particles having a diameter of about 2.0 $\mu$m or greater can generally be removed readily using conventional filtration methods.

In order to minimize the load on the motor, the filter cartridges 20, 20' must be balanced. An imbalance in the filter cartridge 20 may cause mechanical vibration. Mechanical vibration can adversely effect motor life, such as by causing failure of the motor bearing. The mass of the filter cartridge 20 must be uniformly distributed or symmetrical, preferably in a circular shape. That is, the axis of the filter cartridge 20, 20' must be co-linear with the motor axis, and the filter cartridge requires sufficient stiffness with low inertia to avoid operating in a resonance condition.

Figure 3:
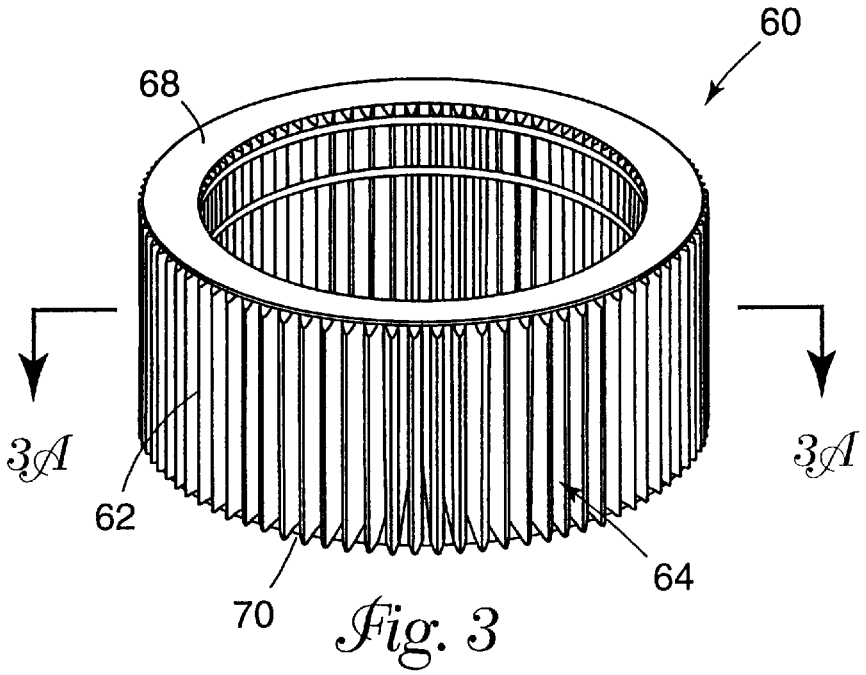
FIG. 3 is a perspective view of an alternate filter cartridge in accordance with the present invention.
Figure 3A:
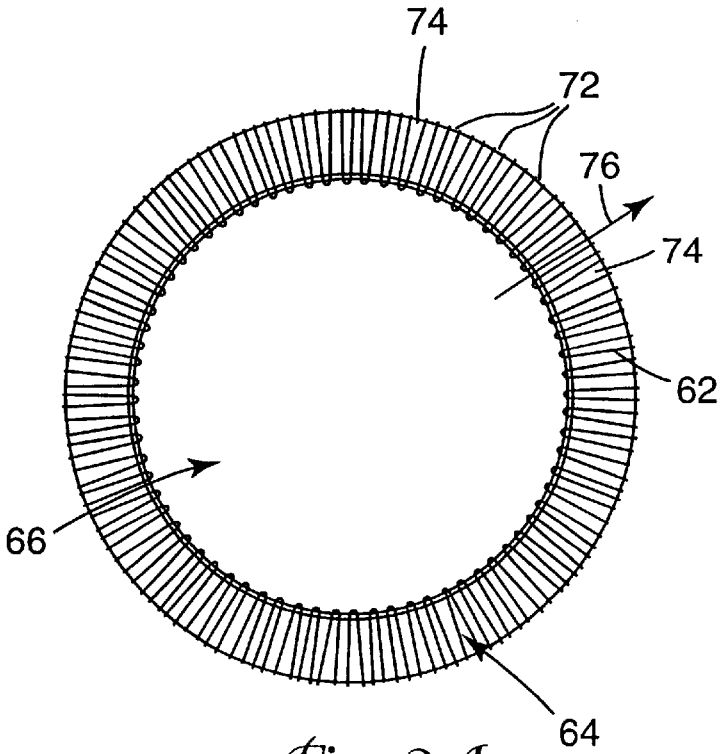
FIG. 3A is a top sectional view of the filter cartridge of FIG. 3.

FIGS. 3 and 3A illustrate an alternate filter cartridge 60 in accordance with the present invention. Filter medium 62 is configured to have a plurality of pleats 64 extending radially outward from a center opening 66. A first rim 68 and a second rim 70 are preferably provided on the ends of the pleated filter medium 62 to increase structural integrity. Tips 72 of at least some of the pleats 64 include slits 74 defining flow passages 76. The term slits is used generically to refer to any hole, notch or other opening in the filter medium. The flow passages 76 maintain a minimum airflow even when the filter medium 62 is fully loaded. The pleats 64 with slits 74 may also behave as a moving fan blades 46 (see FIG. 2) promoting air propulsion and air mixing. In an alternate embodiment, the flow passages 76 are holes formed in the side of some of the pleats 64. In one embodiment, the rims 68, 70 are sized to form an interference fit with the blower wheel. Interference fit refers to a fit wherein one of the mating parts of an assembly is forced into a space provided by the other part in such a way that an overlapping condition is achieved. Alternatively, the rims 68, 70 have a diameter larger than a diameter of the filter medium 62. Consequently, the filter medium 62 does not touch the fan blades when engaged with the blower wheel.

Figure 4:
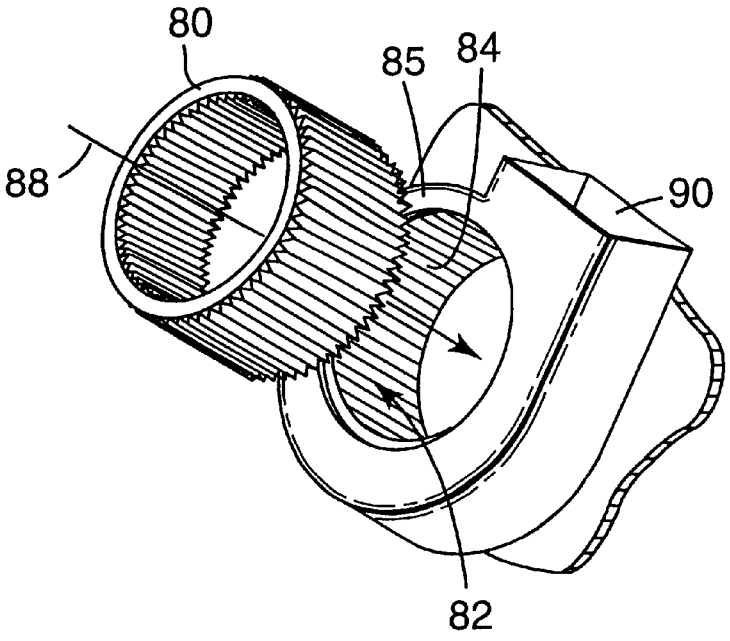
FIG. 4 is a perspective view of a filter cartridge in accordance with the present invention being inserted into a blower cavity.

FIG. 4 is a perspective view of a filter cartridge 80 in accordance with the present invention being inserted into a blower cavity 82 of a blower wheel 84. Center opening of the filter cartridge 80 is concentrically aligned with the blower cavity 82, so as to minimize any resistance to air flow from the air inlet 88 to the air outlet 90. In the embodiment of FIG. 4, the filter cartridge 80 forms a friction fit with the blower wheel 84.

Figure 5A:
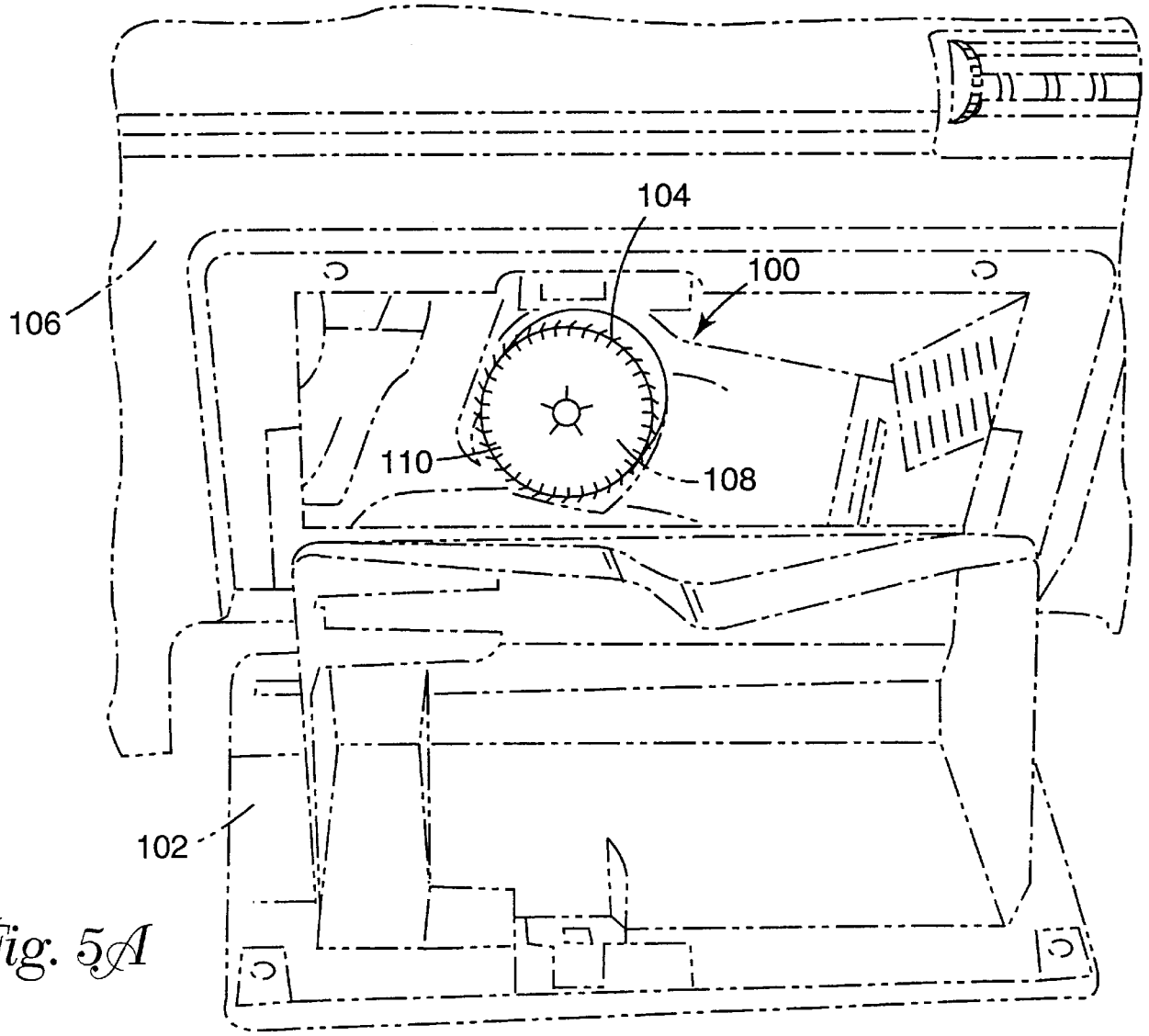
FIG. 5A is a perspective view of an HVAC system in a vehicle.

FIG. 5A is a perspective view of an HVAC system 100 as seen through glove box 102 of the vehicle's dashboard 106. Blower wheel 104 is exposed through access opening 110 accessed through the glove box 102. In the illustrated embodiment, the filter cartridge (e.g., see FIG. 4) is inserted in the blower cavity 108, since no space is available around the outside perimeter of the blower wheel 104. Once installed, a cover (not shown) is placed over the access opening 110 and the glove box 102 is reinstalled.

Figure 5B:
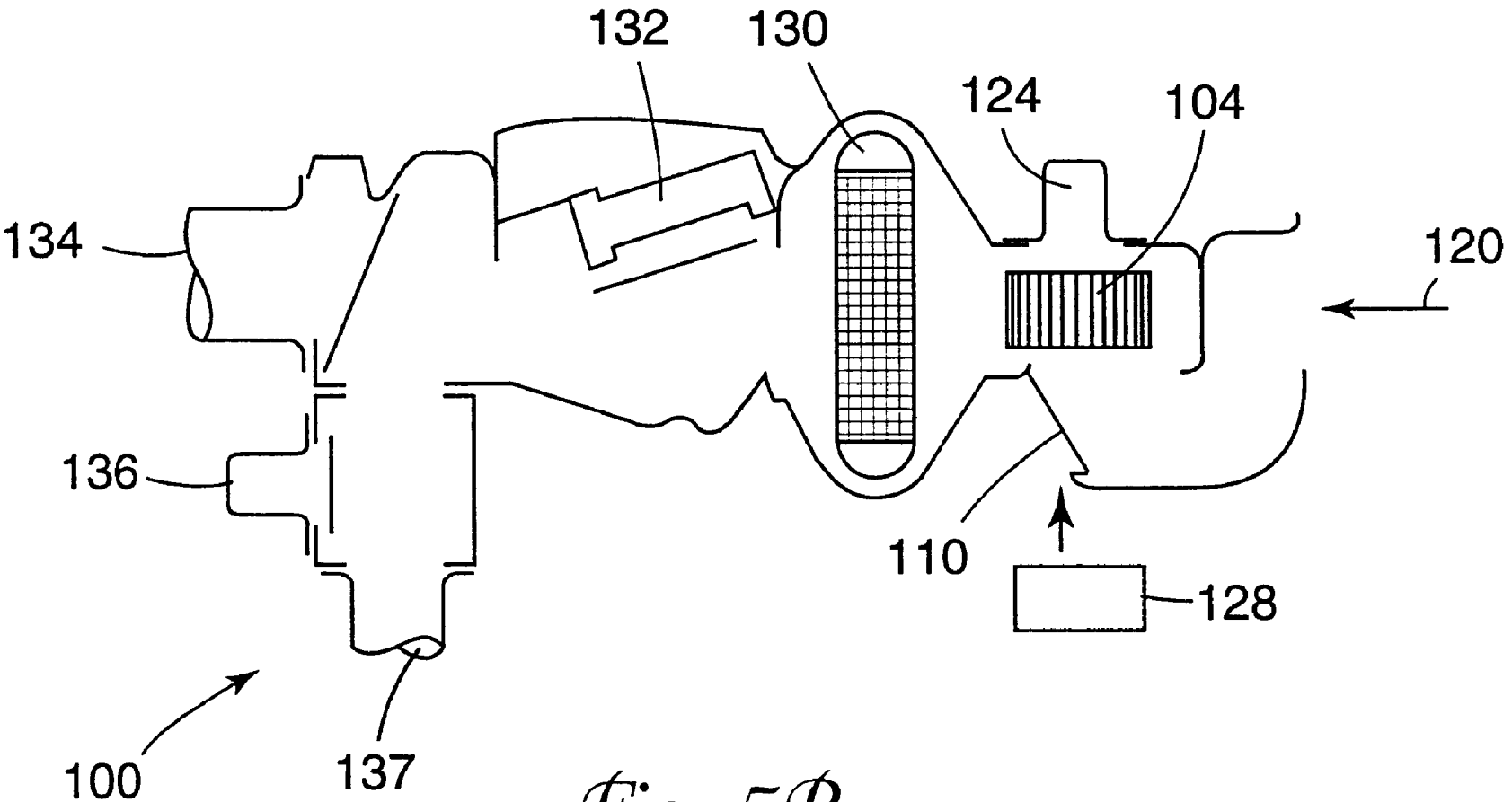
FIG. 5B is a schematic illustration of an HVAC system for a vehicle.

FIG. 5B is a schematic illustration of an HVAC system 100 for an automobile. Outside air 120 is drawn into the system 100 by a blower wheel 104 driven by a blower motor 124. Access opening 110 is formed for insertion of the moving filter 128. Outside air 120 is pressurized by the blower wheel 104 to proceed past evaporator core 130 and heater core 132. The pressurized air can be directed either to the floor of the vehicle 134, the vent panel 137, or to a defroster 136.

Figure 6:
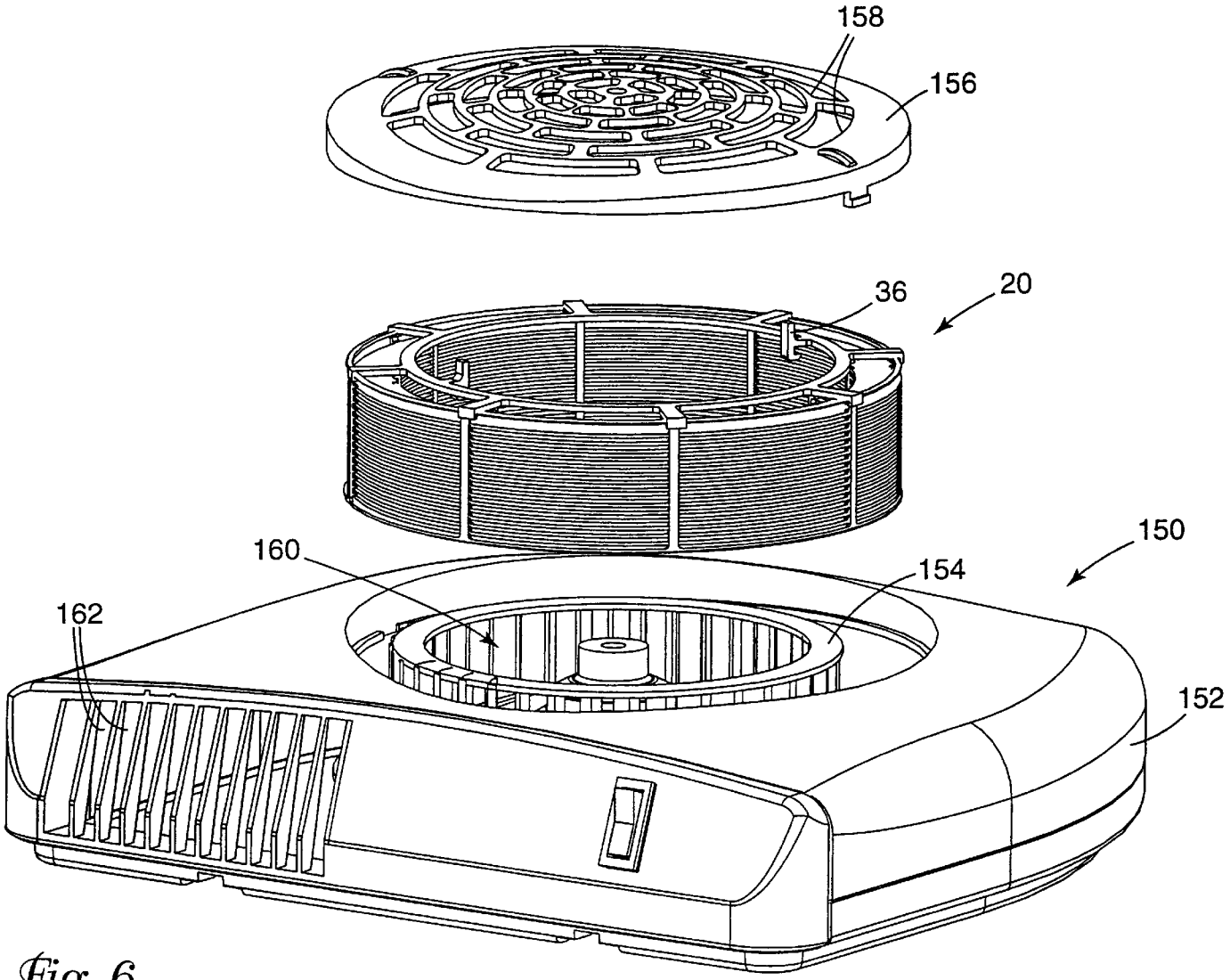
FIG. 6 is an exploded view of a air purifying system in accordance with the present invention.
Figure 7:
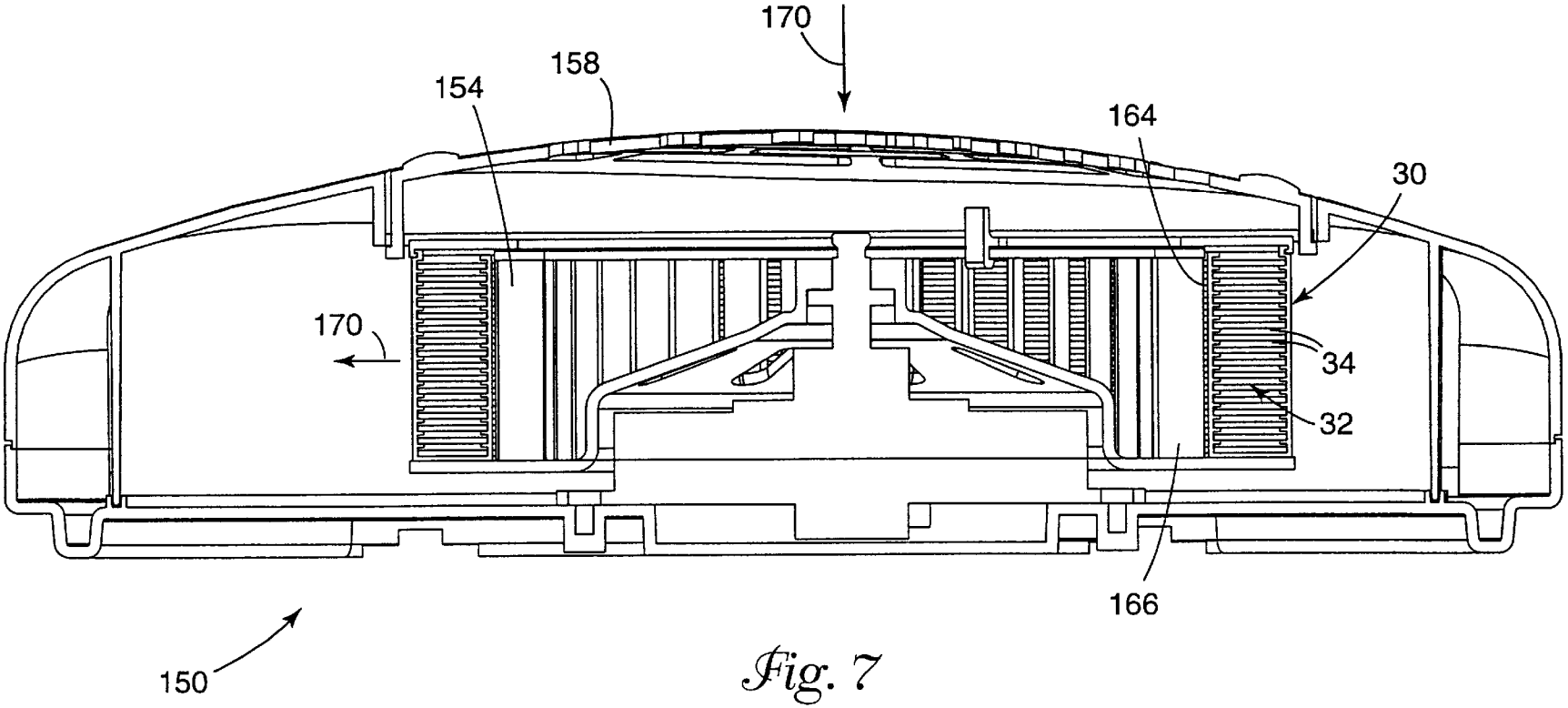
FIG. 7 is a sectional view of the air purifying system of FIG. 6.

FIGS. 6 and 7 illustrate an exemplary air purifying system 150 in accordance with the present invention. The air purifying system 150 is suited for use in a vehicle compartment or building. In the illustrated embodiment, the filter cartridge 20 illustrated in FIG. 1 is inserted into a housing 152 around the outside perimeter of a blower wheel 154. Clips 36 attach the filter cartridge 20 to the blower wheel 154. Inlet cover 156 has a plurality of openings 158 that permit air to be drawn into the blower cavity 160, and expelled though an air outlet 162.

In the engaged configuration, the second filter surface 32 of the filter cartridge 30 is engaged with an outer surface 164 defined by the fan blades 166 on the blower wheel 154. The blower wheel 154 draws air axially along a flow path 170 into the blower cavity 160 through the openings 158 and expels it radially outward past the fan blades 166. The air is permitted to move through the annular air filter elements 22 and through the spaces there between. As the filter element 20 becomes progressively loaded with environmental contaminants, the spacers 34 provide the flow passages through the filter element 20, thereby maintaining a minimum flow rate through the system 150.

Figure 8:
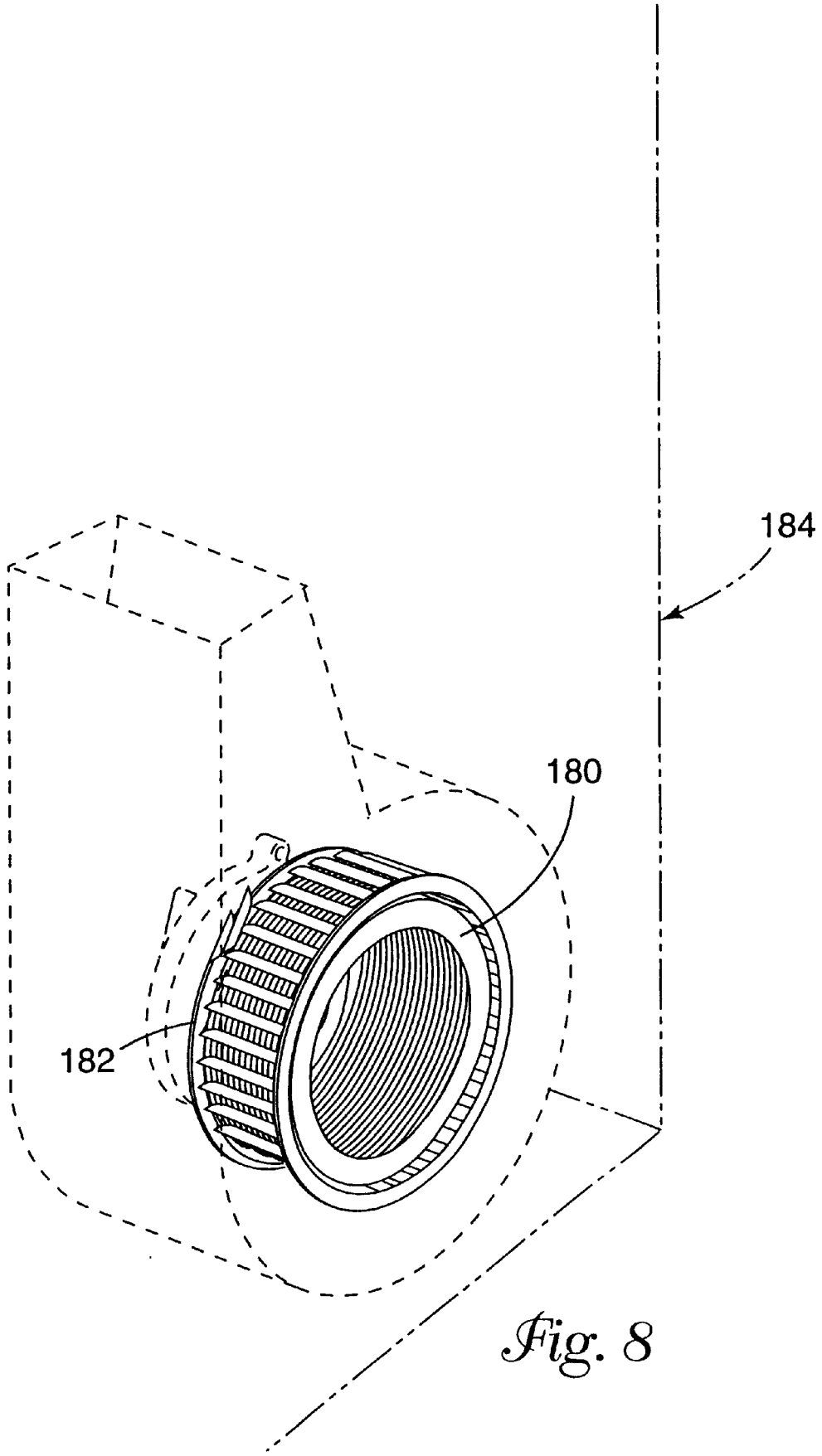
FIG. 8 is a schematic illustration of a furnace utilizing the filtration system in accordance with the present invention.

FIG. 8 is a schematic illustration of a filtration system 180 in accordance with the present invention installed on a radial blower wheel 182 of a building furnace 184.

EXAMPLES

Test Procedures

Clean Air Delivery Rate

Clean air delivery rate provides a measure of the air cleaner performance by using an ANSI standard procedure entitled "Method for Measuring Performance of Portable Household Electric Cord-Connected Room Air Cleaners", ANSI/AHAM AC-1-1988, dated Dec. 15, 1988. This method was modified, as described below in the Time to Cleanup (Particulate Challenge) test, to accommodate and test a variety of filter systems and constructions. Clean Air Delivery Rate (CADR) is defined by the equation $$CADR=V(k_e-k_n)$$

Where V is the volume of the test chamber, $k_e(1/t_{min})$ is the measured decay rate of the particle count in the test chamber resulting from the operation of the air cleaning device being tested per the standard requirements, and $k_e(1/t_{min})$ is the natural decay rate of particle count in the test chamber in the absence of an air cleaning device.

Frazier Permeability

Frazier permeability, a measure of the permeability of a fabric or web to air, was determined according to Federal Test Standard 191A, Method 5450 dated Jul. 20, 1978.

Blower Pressure

The pressure drop of the moving filter in the centrifugal blower unit was determined by using Bernoulli's equation of static pressure as described in "Fluid Mechanics" by V. L. Streeter & E. B Wylie, McGraw-Hill Book Co., pp. 101, 1979.

Time to Cleanup (Particulate Challenge)

This test was designed to characterize the rate at which a filter configuration reduced the particle count of a known volume of air in a re-circulation mode. The test chamber consisted of a "Plexiglas™" box having a one cubic meter ($m^3$) volume. The front sidewall of the test chamber was equipped with a door to allow placement of instrumentation, sensors, power supplies, etc. into the chamber. Each of the two adjacent sidewalls were each equipped with a 10 cm (4 inch) port which served as inlet and/or outlet ports to introduce or evacuate particles from the chamber. One of three smaller 3.8 cm (1.5 inches) diameter ports located on the back sidewall of the chamber was used to probe the particle level in the test chamber. The two other ports were fitted with 0.0254 m (1 inch) diameter 3M Breather Filters, Part No. N900 (available from 3M,St, Paul, Minn.) which exhibited 99.99% efficient capture of particles $\leqq 0.3$ $\mu$m in size. The thus protected ports functioned as breathers to maintain a balanced atmospheric pressure between the test chamber and ambient surroundings.

The interior of the test chamber was also equipped with power outlets that were controlled from outside the chamber. The particle challenge level was adjusted to a constant, controlled level prior to the start of each test by means of a portable room cleaner (available from Holmes Products Corp., Milford, Mass.). A re-circulation fan (available from Duracraft Corp., Whitinsville, Mass.) was used to maintain a uniform mixing of the particulate challenge before the test started. This fan was set at maximum speed during re-circulation and turned off once particle testing started. The particle count analyzer (a "Portable PIus™" HIAC/ROYCO particle counter, available from Pacific Scientific, Silver Spring, Md.) was connected to the test chamber by means of a 6.35 mm OD (¼ inch) tube which was 1.22 m (4 foot) in length. All openings into the test chamber were carefully sealed with gaskets or sealants to minimize particle leakage during testing.

All testing was conducted using background particles from the environment with an additional paper smoke load to bring the initial particle level to about $1.41\times10^8$ particles/$m^3$ ($4\times10^6$ particles per cubic feet). The smoke generator consisted of a stick made of bond paper that was ignited and introduced in the test chamber for a few seconds. The resulting particle concentration was typically above the desired value and the room cleaner was used to reduce the count to a constant baseline of $1.41\times10^8$ particles/$m^3$ ($4\times10^6$ particles/$ft^3$) for all tests.

Once the desired particle concentration level was attained, the moving filter apparatus was turned on and the particle concentration of the chamber was sampled every 30 seconds at a rate of 5.66 liters/min (0.2 $ft^3$/min) to generate the particle decay curve over a period of ten minutes. After each test the chamber was purged of particles. In addition to logging the particle decay curves, the voltage, amperage consumption and rpm's of each filter configuration was recorded using a Fluke instrument, model 87, Everett, Wash. The performance characterization of each moving filter was made following the ANSI/AHAM AC-1-1988 standard. Variations to the standard were the test chamber dimensions, re-circulation fan size, no humidity control, use of a manual smoke generator (paper smoke), frequency of data taking and length of the test (10 minutes).

Time to Cleanup (Vapor Challenge)

The vapor challenge test was designed to characterize the rate at which a filter configuration reduced the vapor concentration in a known volume of air in a re-circulation mode. The test chamber consisted of a "Plexiglas" box having a one cubic meter ($m^3$) volume. The front sidewall of the test chamber was equipped with a door to allow placement of instrumentation, sensors, power supplies, etc. into the chamber. Each of the two adjacent sidewalls were individually equipped with a 10 cm (4 inch) port which served as inlet and/or outlet ports to introduce to or evacuate vapor challenges from the chamber. Two of three smaller 3.8 cm (1.5 inches) diameter ports (center and left) located on the back sidewall of the chamber were used to measure the vapor concentration in the test chamber.

The central port was connected to an infrared gas analyzer (Miran 1B2, available from Foxboro Co., Foxboro, Mass.) by means of a 9.53 mm ID (⅜ inch) and 1.4 m (55 inches) in length "Nalgene™" PE tubing. The sample stream was returned to the chamber through the left port through a 19 mm ID (¾ inch) and 1.35 m (53 inches) long "Nalgene™" PVC tubing connected to the left port of the test chamber. A gas challenge of 80 ppm of toluene was used to measure the performance of the moving filters for all tests.

The toluene challenge was produced by evaporating approximately 340 $\mu$l of toluene in a heated, flat receiver (30×15 mm) that was mounted at a height of 30 cm (11.8 inches) in the chamber. The liquid toluene was injected into the receiver through a 6.3 mm (0.25 inch) orifice positioned at approximately the midpoint of the edge of the right wall next to the door of the test chamber. The orifice was covered with vinyl tape after each injection took place. The re-circulation fan maintained uniform mixing of the 80 ppm toluene gas challenge before the test started. The fan was set at maximum speed during re-circulation and turned off once the gas testing started.

Vapor concentration data was collected at a scanning rate of 10 seconds over a period of 5 minutes by means of a data logger model DL-3200 (available from Metrosonics Inc., Rochester, N.Y.) which was connected to the Miran gas analyzer for each test. The test chamber was purged of any remaining toluene vapors after each test. A log of voltage, and amperage consumption was also kept for each test using a Fluke instrument, model 87. The speed (rpm) of each moving filter was measured using a stroboscope, model 1000, available from Ametek, Inc. from Largo, Fla.

Web Thickness

Web thickness of all particulate media was measured using an electronic digital caliper, Model 721B, from Starrett, Athol, Mass.

Test Configurations

Addon Filter Configuration

A centrifugal blower assembly having a blower wheel 15.25 cm outside diameter, 13.0 cm inside diameter and blade height of 4.3 cm with 38 forward curved blades was used for this test configuration. The blower assembly was driven by a DC motor, which was connected to variable voltage power source allowing the speed of the fan to be controlled and power consumption of the motor to be monitored. The scroll was designed using standard fan & blower design principles. The diffuser angle of the scroll was 8 degrees. Filter elements used in conjunction with this test configuration were sized to fit exterior to the fan blades on the blower wheel.

Automotive HVAC Configuration

A dash assembly, including the air circulation ducting components, was removed from a Ford "Taurus™" and used in this test configuration. An access panel was cut into the blower housing to allow various filter element configurations to be inserted into the blower wheel of the unit. Power was supplied to the motor by a variable voltage power source, which allowed the speed of the fan to be controlled and power consumption of the motor to be monitored. A 15 cm diameter, 130 cm long duct was connected to the inlet side of the HVAC system. A hot wire anemometer (Model "Velocicalc Plus™", available from TSI Inc., St. Paul, Minn.) was mounted at the end of the duct to measure the airflow rate. A manometer was used to measure the pressure developed across the blower wheel with the full HVAC system in place.

A second, identical, HVAC system was then modified by removing the coils, ducting, and cutting the exit side of unit to a size which would fit into the cubic meter box. A solid, sliding baffle plate was placed on the exit of the modified system to enable the system flow and pressure to be adjusted to duplicate the flow and pressure parameters of the system prior to what it had been before several components were removed. This modified unit was then used for all particulate and gas testing. The original full HVAC system was used for all further flow, and power measurements.

Particulate Filter Media

GSB30

A charged fibrillated film filtration media having a basis weight of 30 g/m$^2$ (available from 3M, St. Paul, Minn. under the designation "FITRETE™" Air Filter Media Type GSB30.

GSB50

A charged fibrillated film filtration media having a basis weight of 50 g/m$^2$ (available from 3M under the designation "FITRETE™" Air Filter Media Type GSB50).

GSB70

A charged fibrillated film filtration media having a basis weight of 70 g/m$^2$ (available from 3M under the designation "FITRETE™" Air Filter Media Type GSB70).

GSB150

A charged fibrillated film filtration media having a basis weight of 150 g/m$^2$ (available from 3M under the designation "FITRETE™" Air Filter Media Type GSB150.

Meltblown

A charged blown microfiber web having fiber diameters in the range of about 0.3 micrometers to about 5 micrometers and basis weight of about 70 grams/m$^2$. The web prepared substantially as described in Report No. 4364 of the Naval Research Laboratories, published May 25, 1954, entitled "Manufacture of Super Fine Organic Fibers" by Van Wente et. al. and charged substantially as described in U.S. Pat. No. 4,749,348 (Klaase et. al.)

Fiberglass

A commercially available 70 grams/m$^2$ fiberglass paper with 95% ASHRE efficiency, available from Bernard Dumas S. A., Creysse, France, under the designation B-346W.

Paper

A white, 100% cellulosic paper available from Georgia Pacific Papers, Atlanta, Ga., under the designation "Spectrum-Mimeo™", 75 grams/M$^2$.

Molded Carbon Filters—"Moving" vs. "Static" Comparison

Cylindrically shaped molded carbon filters were prepared from carbon particle agglomerates substantially as described in U.S. Pat. No. 5,332,426 (Tang et.al.), which is incorporated herein by reference, using GG 16×55 carbon granules (available from Kuraray Inc., Osaka, Japan). The molded filters were prepared by packing the carbon particle agglomerates into a steel mold comprised of two coaxial pieces of tubing mounted on a base plate followed by heating the loaded mold in a convection oven (available from Blue M Electric Company, Blue Island, Ill.) at 175° C. for one hour. After cooling to room temperature, the carbon agglomerate cylinder (11.5 cm OD×9.5 cm ID×5.3 cm height) was removed from the mold. A series of 84 holes, about 0.64 centimeters in diameter and substantially uniformly spaced around the cylinder, were subsequently drilled through the wall of the filter to enhance the airflow through the filter, producing about a net 12% open area in the filter and a Frazier Permeability of 12,180 cmh/m$^2$ (666 cfm/ft$^2$). The filter weighed 87 grams after the holes were drilled.

Airflow Through/Open Area Comparison

Cylindrically shaped molded carbon filters were prepared substantially the same as described for the "Moving" vs. "Static" configuration described above except that the dimensions of the molded filter were 12.5 cm OD×10.5 cm ID×5.3 cm height. A further description of the open area of these filters as well as the weight can be found in the carbon filter airflow example.

Filter Assembly—Pleated Filter Cartridges

A rectangular piece of the filter media (sized to provide the desired length of pleated filter media, dependant on the diameter of the blower wheel, pleat depth and pleat density) was formed into pleats using a Rabofsky pleater, (available from Rabofsky GmbH, Berlin, Germany). The pleated strip was mounted on a jig to hold the pleat tips at the desired spacing and two pieces of adhesive thread (String King, available from H. B. Fuller Co., St. Paul Minn.) were attached across the pleat tips to secure their spacing. The spaced, stabilized pleat pack was then wrapped around the blower wheel (or inserted into the blower wheel) and pleats were trimmed to produce a precise fit.

The pleat pack was then removed from the blower wheel, the two ends of the pleat pack were brought together to form a continuous loop and two pieces of adhesive thread about used to span across the inner pleat tips, securing the pleat pack into a cylindrical shape. Two annular poster board rings having the same diameter as the pleated cylinder were attached to the top and bottom of the filter structure using a hot melt adhesive to maintain the cylindrical shape of the filter. The outer diameter tips of the pleated filter constructions were optionally left in tact or slit, to provide a by-pass configuration, prior to testing.

Stacked Ring Configuration

The filter media was die cut into rings having the desired inner and outer diameter to fit into the test blower wheel assembly. Each ring had sixteen equally spaced about 1.6 mm thick×2 mm wide×20 mm length poster board strips adhered to one major surface of the ring using a hot melt adhesive which served to space the disk from adjacent disks. The rings were stacked on top of one another and four plastic "O" shaped clips, sized to the width and height of the filter stack, were symmetrically placed on the filter stack to retain the filter stack in a tight configuration. The filter stack was placed inside the blower wheel, which also acted to further contained the stack.

EXAMPLE 1

Filtration performance of two identical pleated filter constructions in "moving" and "static" configurations were studied using the Time to Cleanup (Particulate Challenge) test described above. The Add-on Filter test unit was tested (described above) wherein the filter elements in both configurations were placed outside the blower wheel.

The filter elements were assembled as described above using GSB70 media approximately 2.55 m (8.4 feet) by 4.13 cm (1.62 inches), which was converted into a pleated filter cartridge with an OD of 19 cm (7.5 in.), an ID of 15.75 cm (6.2 in.) and a height of 4.13 cm (1.62 in.), and having 85 pleats at a 6 mm spacing. Subsequent to assembly into the cartridge, the pleat tips were slit.

The "moving" filter cartridge was mounted directly onto the blower wheel. The "static" filter was positioned just off the surface of the blower wheel by mounting it to the stationary scroll housing such that it did not contact the blower wheel in operation. In both tests, the Add-on Filter test unit was operated at 13 volts and the particle count of the test chamber monitored. Particle count data for the two test configurations are summarized in TABLE 1.

TABLE 1

| Time (Minutes) | "Moving" vs. "Static" Filtration Performance (% Cleanup) | | |
|---|---|---|---|
| | Baseline | "Moving" | "Static" |
| 0 | 3.08 | 0.00 | 0.00 |
| 0.5 | 3.05 | 11.7 | 9.0 |
| 1.0 | 3.02 | 33.1 | 21.5 |
| 1.5 | 2.98 | 54.5 | 37.0 |
| 2.0 | 2.95 | 72.5 | 51.1 |
| 2.5 | 2.91 | 84.4 | 64.7 |
| 3.0 | 2.89 | 91.1 | 74.9 |
| 3.5 | 2.85 | 94.8 | 82.5 |
| 4.0 | 2.82 | 97.1 | 88.0 |

TABLE 1-continued

| Time (Minutes) | "Moving" vs. "Static" Filtration Performance (% Cleanup) | | |
|---|---|---|---|
| | Baseline | "Moving" | "Static" |
| 4.5 | 2.8 | 98.3 | 91.8 |
| 5.0 | 2.75 | 98.9 | 94.5 |
| 5.5 | 2.71 | 99.3 | 96.2 |
| 6.0 | 2.68 | 99.5 | 97.4 |
| 6.5 | 2.65 | 99.7 | 98.1 |
| 7.0 | 2.62 | 99.8 | 98.7 |
| 7.5 | 2.58 | 99.8 | 99.0 |
| 8.0 | 2.55 | 99.8 | 99.3 |
| 8.5 | 2.51 | 99.8 | 99.5 |
| 9.0 | 2.48 | 99.9 | 99.6 |
| 9.5 | 2.45 | 99.9 | 99.7 |
| 10.0 | 2.40 | 99.9 | 99.7 |
| CADR ($m^3$/h) | | 36.6 | 25.6 |

While both the "moving" and "static" filter configurations eventually reached similar particle concentrations in the test apparatus, it is apparent from an examination of the data in TABLE 1 that the "moving" filter configuration was able to reduce the particle count more rapidly than the "static" filter configuration. This performance difference is also reflected in the calculated CADR for the "moving" filter configuration and the "static" filter configuration (36.6 $m^3$/h vs. 25.6 $m^3$/h).

EXAMPLES 2–4

The particle loading performance and subsequent impact on the air delivery of moving filters according to the present invention was examined in the following examples.

An air inlet duct about 15 cm in diameter by about 46 cm long was vertically mounted above the Add-on Filter apparatus described above, with air entering the duct at the top and exiting at the bottom, into the center of the blower wheel. The inlet duct was positioned inside the hood of a TSI model 8370 "Accubalance™" flow measuring hood (available from TSI Inc., St. Paul, Minn. 55164). The 60 cm by 60 cm bottom of the flow measuring hood was blanked off with a sheet of cardboard, with the 15 cm duct projecting through the cardboard blank. In this manner, any air entering the flow measuring hood exited through the 15 cm duct and moving filter unit.

The test dust used for this study was PTI fine (ISO 12103-1,A2), available from Powder Technology Incorporated, Bumsville Minn. 55337, which was dispersed with an ASHRAE 52.1 dust feeder, as described in ASHRAE publication #52.1-92, pages 6–8. (Dust feeders are available from Air Filter Testing Laboratories, Inc., Crestwood, Ky.) The dust feed rate was chosen to produce a dust concentration at the moving filter air inlet of about 75 milligrams per cubic meter. Dispersed dust from the dust feeder was conveyed by compressed air through a 2 cm ID "Tygon™" tube to the throat of the 15 cm duct. Filters were challenged with 15–20 grams of fine test dust, which represents a significantly greater dust challenge than an average automobile HVAC system will encounter over the course of one year of normal operation. The fan was operated at 13 volts to rotate the wheel at about 2400 rpm or at 6.5 volts to rotate the wheel at about 1350 rpm (as indicated in the following tables).

Cartridge filter units were assembled using "FITRETE™" GSB70 media as described above to produce a filter cartridge having an inside diameter of 15.2 cm, an outside diameter of 19.4 cm, and a height of 4.2 cm with 81 pleats at a 6 mm spacing. The outer diameter tips of the pleated filter constructions used Examples 2 and 3 were slit, while they were left intact (not slit) in the filter used in Example 4

EXAMPLE 2

A slit tip pleated filter constructed as described above was weighed, installed on the blower wheel and the filter unit (with the clean filter) operated at about 13 volts (8 amps) which produced an airflow rate of about 4.09 cube meters per minute (146 cubic feet per minute).

PTI fine test dust was fed to the blower in increments of about 2 grams, after which the voltage and amp draw were recorded and the filter removed from the blower wheel and weighed. After weighing, the filter was reinstalled on the blower wheel, the filter unit returned to operation at the original voltage, and the unit exposed to the next increment of test dust. In this way the gravimetric particle collection was measured for comparison against blower performance, the results of which are reported in TABLE 2.

TABLE 2

| Particle Loading Airflow Correlation | | | | | |
|---|---|---|---|---|---|
| Cumulative Dust Fed (gms) | Filter Weight Gain (gms) | Particle Removal Efficiency (%) | Airflow Rate ($m^3$/min) | Volts | Amps |
| 0 | — | — | 4.09 | 13 | 8.0 |
| 2 | 0.77 | 38.5 | 3.92 | 13 | 8.0 |
| 4 | 0.71 | 35.5 | 3.86 | 13 | 7.8 |
| 6 | 0.70 | 35.0 | 3.86 | 13 | 7.7 |
| 8 | 0.75 | 37.5 | 3.92 | 13 | 7.8 |
| 10 | 0.65 | 32.5 | 3.89 | 13 | 7.6 |
| 12 | 0.75 | 37.5 | 3.92 | 13 | 7.6 |
| 14 | 0.63 | 31.5 | 3.92 | 13 | 7.6 |
| 16 | 0.55 | 27.5 | 3.89 | 13 | 7.6 |
| 18 | 0.67 | 33.5 | 3.89 | 13 | 7.6 |
| 20 | 0.55 | 27.5 | 3.89 | 13 | 7.7 |

Examination of the data in TABLE 2 shows that the filter unit exhibited an average particle removal efficiency of 33.7% (corresponding to 6.73 gms dust collected) with a minimal reduction (4.9%) in airflow rate through the unit.

EXAMPLE 3

A filter loading/performance study was conducted as described in Example 2 except that the filter unit (with the clean filter) was operated at 6.5 volts (2.7 amps) which produced an airflow rate of 2.1 cubic meters per minute (74 cubic feet per minute). The gravimetric loading/filter performance data are reported TABLE 3.

TABLE 3

| Particle Loading Airflow Correlation | | | | | |
|---|---|---|---|---|---|
| Cumulative Dust Fed (gms) | Filter Weight Gain (gms) | Particle Removal Efficiency (%) | Airflow Rate ($m^3$/min) | Volts | Amps |
| 0 | — | — | 2.1 | 6.5 | 2.7 |
| 2 | 0.97 | 48.5 | 2.0 | 6.5 | 2.6 |

TABLE 3-continued

| Particle Loading Airflow Correlation | | | | | |
|---|---|---|---|---|---|
| Cumulative Dust Fed (gms) | Filter Weight Gain (gms) | Particle Removal Efficiency (%) | Airflow Rate ($m^3$/min) | Volts | Amps |
| 4 | 1.12 | 56.0 | 2.0 | 6.5 | 2.6 |
| 6 | 0.96 | 48.0 | 2.0 | 6.5 | 2.6 |
| 8 | 0.83 | 41.5 | 2.0 | 6.5 | 2.6 |
| 10 | 0.74 | 37.0 | 2.0 | 6.5 | 2.6 |
| 12 | 0.77 | 38.5 | 2.0 | 6.5 | 2.6 |
| 14 | 1.03 | 51.5 | 2.0 | 6.5 | 2.5 |
| 16 | 0.57 | 28.5 | 1.9 | 6.5 | 2.5 |
| 18 | 0.94 | 47.0 | 1.9 | 6.5 | 2.5 |
| 20 | 0.66 | 33.0 | 1.9 | 6.5 | 2.5 |

Examination of the data in TABLE 3 shows that the filter unit exhibited an average particle removal efficiency of 42.95% (corresponding to 8.59 gms dust collected) with a nominal reduction (9.5%) in airflow rate through the unit.

EXAMPLE 4

A filter loading/performance study was conducted as described in Example 2 except that the tips of the pleated filter were not slit. The filter unit (with the clea filter) was operated at 13 volts (7.5 amps) and produced an airflow rate of 3.98 cubic meters per minute (142 cubic feet per minute). PTI fine test dust was fed to the blower in increments of 1 gram until a total of 5 grams had been fed, after which the dust was fed in 2 gram increments. The gravimetric loading/filter performance data are reported in TABLE 4.

TABLE 4

| Particle Loading Airflow Correlation | | | | | |
|---|---|---|---|---|---|
| Cumulative Dust Fed (gms) | Filter Weight Gain (gms) | Particle Removal Efficiency (%) | Airflow Rate ($m^3$/min) | Volts | Amps |
| 0 | — | — | 3.98 | 13 | 7.5 |
| 1 | 0.81 | 81.0 | 3.86 | 13 | 7.5 |
| 2 | 0.67 | 67.0 | 3.78 | 13 | 7.5 |
| 3 | 0.65 | 65.0 | 3.70 | 13 | 7.6 |
| 4 | 0.59 | 59.0 | 3.70 | 13 | 7.5 |
| 5 | 0.78 | 78.0 | 3.70 | 13 | 7.5 |
| 7 | 1.25 | 62.5 | 3.67 | 13 | 7.5 |
| 9 | 1.29 | 64.5 | 3.53 | 13 | 7.6 |
| 11 | 1.31 | 65.5 | 3.53 | 13 | 7.5 |
| 13 | 1.17 | 58.5 | 3.36 | 13 | 7.6 |
| 15 | 1.22 | 61.0 | 3.25 | 13 | 7.6 |

Examination of the data in TABLE 4 shows that while the filter cartridge having intact tips (i.e. un-slit) exhibited a particle capture efficiency of 64.9% (corresponding to 9.74 gms dust collected), the higher efficiency was realized at the expense of a significant reduction (18%) in airflow rate through the unit.

The data in TABLES 2 and 3 also demonstrate that the gravimetric efficiency of moving filters is higher at lower rotational speeds than at higher rotational speeds, and that over the course of exposure to 20 gms of test dirt, filters having slit pleats are non-plugging while offering useful particle removal performance.

EXAMPLE 5

Filtration performance of two identical stacked disc filter constructions in "moving" and "static" configurations were studied substantially as described in Example 3 except that a stacked disk filter construction was used instead of a slit tip pleaded construction.

Two identical stacked filter disk configurations were prepared using 20 rings of GSB70 filter media having 17 cm OD and 13 cm ID (6.75 in. OD and 5.25 in. ID) as described above. Each filter stack was fitted with stabilizing rings on the bottom of the stack to facilitate mounting the stack in the blower wheel or on the blower housing of the "Add-on" test configuration. The bottom stabilizing cardboard ring for the filter stack used in the "moving" configuration had an ID of about 12.1 cm which produced a friction fit between the blower wheel and the filter carfridge, thereby moving the filter cartridge in unison with the blower wheel. The bottom stabilizing cardboard ring for the filter cartridge used in the static test configuration had an ID of about 13 cm which allowed the blower wheel to spin while the filter cartridge was maintained in a static position, supported by a wall of the fan scroll opposite the motor. A cardboard spacer was positioned on the support wall to position the static filter in substantially the same position maintained by the moving filter. The fan operated at about 12 volts (2900 rpm) for both the "moving" and "static" filtration test procedures. Particle count data for the two filter configurations are reported in TABLE 5.

TABLE 5

| Filtration Performance "Moving" vs. "Static" Configuration (Particle Count × $10^5$) | | | |
|---|---|---|---|
| Time (Minutes) | Baseline | "Moving" Filter | Static Filter |
| 0 | 3.08 | 3.12 | 3.11 |
| 0.5 | 3.05 | 2.75 | 2.94 |
| 1.0 | 3.02 | 1.86 | 2.68 |
| 1.5 | 2.98 | 1.02 | 2.38 |
| 2.0 | 2.95 | 0.512 | 2.04 |
| 2.5 | 2.91 | 0.250 | 1.70 |
| 3.0 | 2.89 | 0.102 | 1.39 |
| 3.5 | 2.85 | 0.078 | 1.11 |
| 4.0 | 2.82 | 0.052 | 0.859 |
| 4.5 | 2.78 | 0.039 | 0.666 |
| 5.0 | 2.75 | 0.036 | 0.514 |
| 5.5 | 2.71 | 0.032 | 0.395 |
| 6.0 | 2.68 | 0.033 | 0.308 |
| 6.5 | 2.65 | 0.032 | 0.239 |
| 7.0 | 2.62 | 0.033 | 0.187 |
| 7.5 | 2.58 | 0.032 | 0.146 |
| 8.0 | 2.55 | 0.033 | 0.117 |
| 8.5 | 2.51 | 0.033 | 0.091 |
| 9.0 | 2.48 | 0.033 | 0.073 |
| 9.5 | 2.45 | 0.035 | 0.056 |
| 10.0 | 2.40 | 0.034 | 0.047 |
| CADR ($m^3$/h) | | 61.1 | 26.1 |

While the final particle count for the two filter configurations is similar, the calculated CADRs for the "moving" and "static" filter configurations, based on the data presented in TABLE 5 of about 61.1 $m^3$/h (36.0 $ft.^3$/min) and about 26.1 $m^3$/h (15.3 $ft.^3$/min), demonstrates that with identical filter configurations in comparable fluid flow environments, the filter in a "moving" configuration is capable of removing particles more rapidly than the same filter in a "static" configuration.

EXAMPLE 6

The filtration performance of a pleated, slit tip, moving filter in an automotive HVAC system in both a "moving" and "static" configuration (as described in Example 1) was evaluated using the Time to Cleanup (Particulate Challenge) test. The duct/blower unit of the second automotive HVAC test configuration (described above) with the baffle adjusted to simulate the actual operating pressure of the full HVAC system was used for this test. The filter cartridge used in this evaluation used pleated GSB70 media, an 11.8 cm OD, a 5.4 cm wide, 47 pleats with a 9 mm height at a 6 mm spacing, and an active filter area of 457 $cm^2$ (71 $in^2$).

In the "moving" configuration, four tabs were attached to the filter cartridge using a hot melt adhesive which allowed the filter to be mounted on the blower wheel, thereby maintaining the cartridge in position during operation. In the "static" configuration, the filter cartridge was mounted on a bracket on the access panel of the blower assembly opposite the blower wheel such that the cartridge could be inserted into the blower wheel, yet not touch it during operation. In both tests, the automotive HVAC unit was operated at about 9 volts. Particle count data for the two test configurations are summarized in TABLE 6.

TABLE 6

| "Moving" vs. "Static" Filtration Performance of Automotive HVAC Unit (% Cleanup) | | |
|---|---|---|
| Time (minutes) | "Moving" | "Static" |
| 0 | 0 | 0 |
| 0.5 | 10.2 | 7.4 |
| 1.0 | 31.8 | 21.6 |
| 1.5 | 54.8 | 38.4 |
| 2.0 | 73.1 | 54.9 |
| 2.5 | 84.7 | 68.5 |
| 3.0 | 91.6 | 78.7 |
| 3.5 | 95.4 | 86.0 |
| 4.0 | 97.4 | 90.8 |
| 4.5 | 98.4 | 94.0 |
| 5.0 | 99.0 | 96.0 |
| 5.5 | 99.4 | 97.3 |
| 6.0 | 99.5 | 98.1 |
| 6.5 | 99.6 | 98.7 |
| 7.0 | 99.6 | 98.9 |
| 7.5 | 99.7 | 99.2 |
| 8.0 | 99.7 | 99.4 |
| 8.5 | 99.8 | 99.5 |
| 9.0 | 99.8 | 99.5 |
| 9.5 | 99.8 | 99.7 |
| 10.0 | 99.8 | 99.7 |
| CADR ($m^3$/h) | 37.0 | 25.9 |

As was the case with the "moving" and "static" configurations characterized in Example 1, both systems reached similar particle concentrations at the conclusion of the test. Similarly, the "moving" configuration in the automotive HVAC system was able to reduce the particle count much more rapidly than the "static" filter configuration. This performance difference was also reflected in that the calculated CADR for the "moving" filter configuration and the "static" filter configuration (37.0 $m^3$/h vs. 25.9 $m^3$/h respectively).

EXAMPLE 7

The filtration performance of several filter media as a function of the permeability of the media was studied using the Automotive HVAC Configuration—second configuration (described above) in the Time to Cleanup (Particulate Challenge) test (also described above). The blower wheel of the automobile HVAC unit was fitted with a pleated filter cartridge having an OD of about 12.38 cm, an ID of about 10.48 cm, and a height of about 5.4 cm, prepared as described above, with 56 pleats at a pleat spacing of about 6 mm, each pleat being about 10 mm in height and made from the indicated filter media (described above). All of the pleated cartridges used in this example had intact pleat tips (i.e. the pleat tips were not slit). The blower unit was placed in the test apparatus, a known particulate challenge introduced into the box, and the unit operated at about 2600 rpm (about 9 volts). Particle count data for these studies are reported in TABLE 7.

TABLE 7

Pleat Tips Intact
Particle count vs. Time
(Particle Count × $10^5$)

| Time (min) | Base-line | GSB30 | GSB50 | GSB70 | Melt-blown | Fiber Glass | Paper |
|---|---|---|---|---|---|---|---|
| 0 | 3.08 | 3.11 | 3.11 | 3.10 | 3.08 | 3.11 | 3.09 |
| 0.5 | 3.05 | 2.78 | 2.55 | 2.22 | 2.73 | 2.92 | 3.00 |
| 1.0 | 3.02 | 2.18 | 1.62 | 1.03 | 2.22 | 2.64 | 2.91 |
| 1.5 | 2.98 | 1.55 | 0.868 | 0.389 | 1.64 | 2.30 | 2.83 |
| 2.0 | 2.95 | 1.03 | 0.436 | 0.150 | 1.13 | 1.94 | 2.73 |
| 2.5 | 2.91 | 0.665 | 0.214 | 0.064 | 0.758 | 1.60 | 2.63 |
| 3.0 | 2.89 | 0.421 | 0.114 | 0.035 | 0.483 | 1.29 | 2.53 |
| 3.5 | 2.85 | 0.275 | 0.067 | 0.026 | 0.314 | 1.02 | 2.44 |
| 4.0 | 2.82 | 0.187 | 0.043 | 0.023 | 0.204 | 0.802 | 2.34 |
| 4.5 | 2.78 | 0.130 | 0.034 | 0.022 | 0.136 | 0.623 | 2.23 |
| 5.0 | 2.75 | 0.097 | 0.029 | 0.021 | 0.093 | 0.490 | 2.13 |
| 5.5 | 2.71 | 0.078 | 0.027 | 0.021 | 0.067 | 0.388 | 2.02 |
| 6.0 | 2.68 | 0.062 | 0.026 | 0.021 | 0.053 | 0.303 | 1.92 |
| 6.5 | 2.65 | 0.055 | 0.027 | 0.021 | 0.044 | 0.245 | 1.82 |
| 7.0 | 2.62 | 0.049 | 0.026 | 0.022 | 0.040 | 0.200 | 1.72 |
| 7.5 | 2.58 | 0.047 | 0.026 | 0.022 | 0.036 | 0.163 | 1.63 |
| 8.0 | 2.55 | 0.044 | 0.025 | 0.023 | 0.034 | 0.142 | 1.53 |
| 8.5 | 2.51 | 0.042 | 0.026 | 0.022 | 0.032 | 0.121 | 1.46 |
| 9.0 | 2.48 | 0.040 | 0.027 | 0.023 | 0.031 | 0.106 | 1.36 |
| 9.5 | 2.45 | 0.043 | 0.026 | 0.022 | 0.031 | 0.094 | 1.27 |
| 10.0 | 2.40 | 0.042 | 0.026 | 0.022 | 0.030 | 0.086 | 1.21 |

Examination of the data in TABLE 7 shows that when operating at comparable conditions in a "moving filter" configuration, more porous filtration materials (i.e. GSB30, GSB50, GSB70 & meltblown) are more effective in removing particles than less permeable materials (i.e. fiberglass, & paper).

Figure 9:
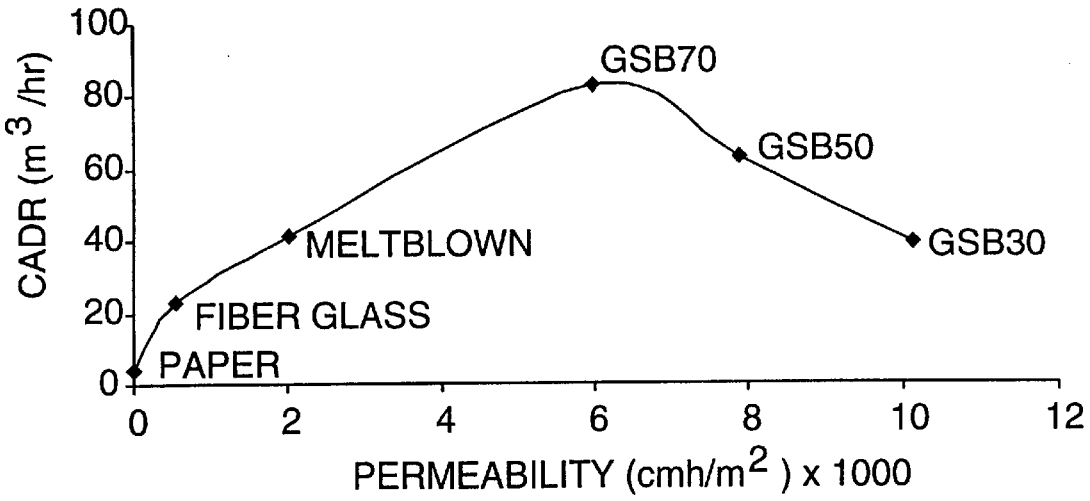
FIG. 9 is a graphic representation of data relating to media permeability on filter performance.

The Clean Air Delivery Rate (CADR) calculated on the data shown in TABLE 7 for the various filtration media are shown in TABLE 8 and graphically presented in FIG. 9, where the CADR is compared to the permeability of the filtration media.

TABLE 8

Pleat Tips Intact
CADR vs. Media Permeability

| Filtration | Frazier Permeability[1] | | CADR[2] | |
|---|---|---|---|---|
| Material | $m^3/h/m^2$ | $Ft.^3/h/ft^2$ | $m^3/h$ | $ft.^3/min$ |
| GSB30 | 10,122 | 553.5 | 39.2 | 23.1 |
| GSB50 | 7,888 | 431.3 | 62.9 | 37.0 |
| GSB70 | 5,969 | 326.4 | 83.1 | 48.9 |
| Meltblown | 2,011 | 110 | 41.5 | 24.4 |
| Fiber Glass | 554 | 30.3 | 22.9 | 13.5 |
| Paper | 6.4 | 0.35 | 4.2 | 2.5 |

[1]Determined as described in the Frazier using the permeability test procedure above.
[2]Calculated as described in the "Method for Measuring Performance of Portable Household Electric Cord-Connected Room Air Cleaners," ANSI/AHAM AC-1-1988.

The inter-relationship of media permeability (Frazier Permeability) and CADR in a pleated filter cartridge configuration operating in the automotive HVAC unit is readily apparent from an examination of the data in TABLE 8 or FIG. 9 and paralleled the inter-relationship demonstrated with the mini-turbo fan configuration.

EXAMPLE 8

Example 7 was repeated using a pleated filter cartridge having slit tips to increase the permeability of the filter media. Particle count data for these studies are reported in TABLE 9.

TABLE 9

Slit Pleat Tips
Particle count vs. Time
(Particle Count × $10^5$)

| Time (min) | Base-line | GSB30 | GSB50 | GSB70 | Melt-blown | Fiber Glass | Paper |
|---|---|---|---|---|---|---|---|
| 0 | 3.08 | 3.11 | 3.08 | 3.08 | 3.09 | 3.07 | 3.07 |
| 0.5 | 3.05 | 2.83 | 2.62 | 2.52 | 2.83 | 2.87 | 2.98 |
| 1.0 | 3.02 | 2.35 | 1.89 | 1.57 | 2.34 | 2.26 | 2.87 |
| 1.5 | 2.98 | 1.83 | 1.20 | 0.817 | 1.79 | 2.26 | 2.76 |
| 2.0 | 2.95 | 1.36 | 0.733 | 0.398 | 1.28 | 1.90 | 2.64 |
| 2.5 | 2.91 | 0.960 | 0.444 | 0.194 | 0.866 | 1.55 | 2.50 |
| 3.0 | 2.89 | 0.676 | 0.282 | 0.111 | 0.571 | 1.25 | 2.36 |
| 3.5 | 2.85 | 0.472 | 0.191 | 0.070 | 0.371 | 0.976 | 2.23 |
| 4.0 | 2.82 | 0.340 | 0.135 | 0.049 | 0.244 | 0.769 | 2.10 |
| 4.5 | 2.78 | 0.252 | 0.096 | 0.040 | 0.160 | 0.594 | 1.96 |
| 5.0 | 2.75 | 0.189 | 0.075 | 0.037 | 0.107 | 0.467 | 1.81 |
| 5.5 | 2.71 | 0.153 | 0.061 | 0.033 | 0.073 | 0.367 | 1.69 |
| 6.0 | 2.68 | 0.126 | 0.055 | 0.034 | 0.052 | 0.300 | 1.56 |
| 6.5 | 2.65 | 0.104 | 0.047 | 0.039 | 0.039 | 0.248 | 1.43 |
| 7.0 | 2.62 | 0.091 | 0.047 | 0.037 | 0.031 | 0.208 | 1.32 |
| 7.5 | 2.58 | 0.077 | 0.041 | 0.033 | 0.026 | 0.181 | 1.21 |
| 8.0 | 2.55 | 0.075 | 0.039 | 0.030 | 0.023 | 0.160 | 1.10 |
| 8.5 | 2.51 | 0.067 | 0.036 | 0.030 | 0.021 | 0.136 | 1.01 |
| 9.0 | 2.48 | 0.058 | 0.036 | 0.027 | 0.021 | 0.120 | 0.921 |
| 9.5 | 2.45 | 0.058 | 0.036 | 0.026 | 0.023 | 0.110 | 0.841 |
| 10.0 | 2.40 | 0.058 | 0.034 | 0.030 | 0.021 | 0.099 | 0.764 |

Examination of the data in TABLE 9 shows that when operating at comparable conditions in a "moving filter" configuration, more porous (i.e. slit pleat tip filter configurations) are capable of reducing particulate challenges to levels approximating those produced by filter cartridges having intact pleat tips, but that the clean-up occurs at a slower rate.

Figure 10:
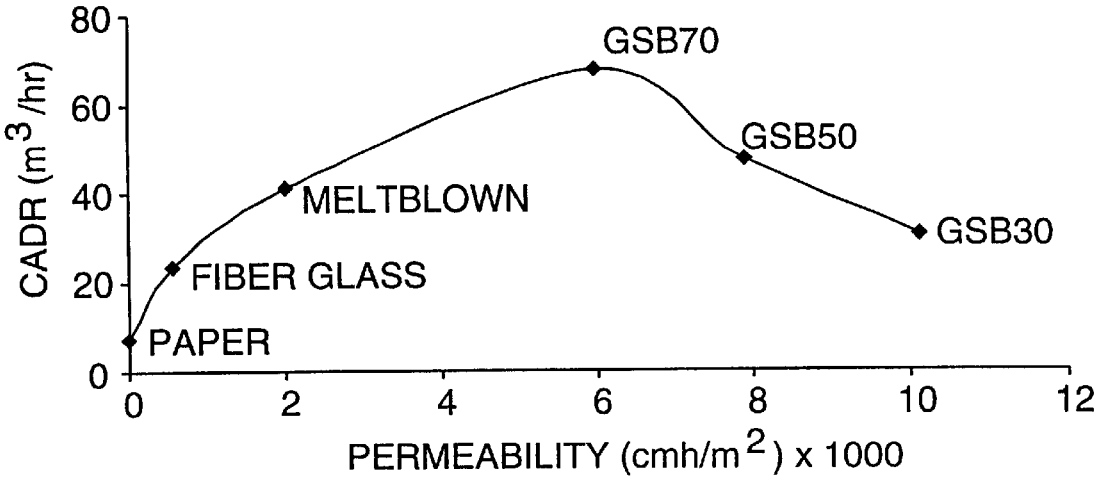
FIG. 10 is a graphic representation of data relating to media permeability on filter performance.

The Clean Air Delivery Rate (CADR) calculated on the data shown in TABLE 9 for the various filtration media are shown in TABLE 10 and graphically presented in FIG. 10, where the CADR is compared to the permeability of the filtration media.

TABLE 10

Slit Pleat Tips
CADR vs. Media Permeability

| Filtration | Frazier Permeability[1] | | CADR[2] | |
|---|---|---|---|---|
| Material | $m^3/h/m^2$ | $Ft.^3/h/ft^2$ | $M^3/h$ | $ft.^3/min$ |
| GSB30 | 10,122 | 553.5 | 30.6 | 18.0 |
| GSB50 | 7,888 | 431.3 | 47.7 | 28.1 |
| GSB70 | 5,969 | 326.4 | 67.8 | 39.9 |
| Meltblown | 2,011 | 110 | 40.9 | 24.1 |

TABLE 10-continued

| Slit Pleat Tips CADR vs. Media Permeability | | | | |
|---|---|---|---|---|
| Filtration | Frazier Permeability[1] | | CADR[2] | |
| Material | $m^3/h/m^2$ | $Ft.^3/h/ft^2$ | $M^3/h$ | $ft.^3/min$ |
| Fiber Glass | 554 | 30.3 | 23.4 | 13.8 |
| Paper | 6.4 | 0.35 | 7.1 | 4.2 |

[1]Determined as described in the Frazier permeability test procedure above.
[2]Calculated as described in the "Method for Measuring Performance of Portable Household Electric Cord-Connected Room Air Cleaners," ANSI/AHAM AC-1-1988.

The inter-relationship of media permeability (Frazier Permeability) and CADR in a pleated filter cartridge configuration operating in the automotive HVAC unit is readily apparent from an examination of the data in TABLE 10 or FIG. 10 and exhibited a pattern similar to the pleated filter cartridge having intact pleat tips. It is interesting to note that increasing the overall permeability of the filter media by slitting the pleat tips reduces the CADR for filter cartridges based on more permeable filtration media (GSB30, GSB50, GSB70 & meltblown) while it maintains or increases the CADR for filter cartridges based on less permeable filtration media (fiber glass and paper).

EXAMPLE 9

Filtration performance of GSB30, GSB50, GSB70, and meltblown filtration media was compared in moving/charged, moving/uncharged, and static/uncharged configurations using the Time to Cleanup (Particulate Challenge) test and the automotive HVAC test configuration. The blower wheel of the HVAC unit was fitted with a clean pleated filter made of the indicated media, which was prepared as described above, for each test run. The filter cartridges had 50 pleats, a 6 mm pleat spacing, a pleat height of 10 mm, and 11.43 cm OD×9.53 cm ID×5.08 cm height with a poster board rings added to the top and bottom of the cartridge for added strength. Each filter cartridge was also fitted with a 3.81 cm diameter paper cone inside the filter loop to avoid air bypass in the blower wheel.

Moving filters were attached directly to the blower wheel by means of poster board tabs and the static filters were mounted to a supporting ring made of poster board attached to the back side of the housing unit of the blower assembly, which provided a clearance of 0.635 cm between the filter and the blower wheel sides and 0.95 cm clearance between the filter and the base of the blower wheel. The static filters were also fitted with a paper cone to avoid air bypass in the blower wheel. All filter configurations were subject to the same particle challenge, the HVAC unit was operated at 9 volts (2800 rpm) and the particle count in the test apparatus was monitored at 30 second intervals for a period of 10 minutes. Particle count data for the GSB30 filters is reported in TABLE 11, particle count data for the GSB50 filters is reported in TABLE 12, particle count data for the GSB70 filters is reported in TABLE 13, and particle count data for the meltblown filters is reported in TABLE 14.

TABLE 11

| Filtration Performance of GSB30 Media (% Cleanup) | | | |
|---|---|---|---|
| Time (minutes) | GSB30 Charged/ Moving | GSB30 Uncharged/ Moving | GSB30 Uncharged/ Static |
| 0 | 0 | 0 | 0 |
| 0.5 | 12.8 | 7.15 | 5.4 |
| 1.0 | 35.1 | 19.95 | 14.6 |
| 1.5 | 56.6 | 34.3 | 24.9 |
| 2.0 | 73.6 | 48.6 | 35.8 |
| 2.5 | 84.6 | 61.2 | 46.4 |
| 3.0 | 91.1 | 71.5 | 55.8 |
| 3.5 | 94.7 | 79.4 | 64.8 |
| 4.0 | 96.9 | 85.1 | 72.0 |
| 4.5 | 98.0 | 89.4 | 77.9 |
| 5.0 | 98.7 | 92.3 | 82.5 |
| 5.5 | 99.0 | 94.3 | 86.2 |
| 6.0 | 99.2 | 95.9 | 89.0 |
| 6.5 | 99.4 | 96.9 | 91.1 |
| 7.0 | 99.5 | 97.5 | 92.7 |
| 7.5 | 99.5 | 98.0 | 93.8 |
| 8.0 | 99.6 | 98.4 | 94.6 |
| 8.5 | 99.5 | 98.6 | 95.5 |
| 9.0 | 99.5 | 98.8 | 96.1 |
| 9.5 | 99.6 | 98.9 | 96.7 |
| 10.0 | 99.6 | 99.1 | 97.0 |
| CADR ($m^3/h$) | 53.3 | 33.0 | 22.9 |

TABLE 12

| Filtration Performance of GSB50 Media (% Cleanup) | | | |
|---|---|---|---|
| Time (minutes) | GSB50 Charged/ Moving | GSB50 Uncharged/ Moving | GSB50 Uncharged/ Static |
| 0 | 0 | 0 | 0 |
| 0.5 | 19.5 | 6.4 | 4.9 |
| 1.0 | 51.8 | 18.6 | 13.8 |
| 1.5 | 76.5 | 32.2 | 24.4 |
| 2.0 | 88.7 | 46.5 | 35.8 |
| 2.5 | 94.7 | 58.7 | 46.7 |
| 3.0 | 97.2 | 69.5 | 56.9 |
| 3.5 | 98.4 | 77.5 | 66.0 |
| 4.0 | 98.9 | 83.7 | 73.2 |
| 4.5 | 99.2 | 88.1 | 79.2 |
| 5.0 | 99.3 | 91.3 | 83.8 |
| 5.5 | 99.3 | 93.7 | 87.5 |
| 6.0 | 99.3 | 95.3 | 90.3 |
| 6.5 | 99.4 | 96.5 | 92.5 |
| 7.0 | 99.4 | 97.2 | 94.1 |
| 7.5 | 99.4 | 97.6 | 95.4 |
| 8.0 | 99.4 | 98.0 | 96.5 |
| 8.5 | 99.4 | 98.3 | 97.2 |
| 9.0 | 99.4 | 98.5 | 978.7 |
| 9.5 | 99.4 | 98.7 | 98.1 |
| 10.0 | 99.4 | 98.7 | 98.4 |
| CADR ($m^3/h$) | 70.8 | 31.5 | 26 |

TABLE 13

| Filtration Performance of GSB70 Media (% Cleanup) | | | |
|---|---|---|---|
| Time (minutes) | GSB70 Charged/ Moving | GSB70 Uncharged/ Moving | GSB70 Uncharged/ Static |
| 0 | 0 | 0 | 0 |
| 0.5 | 23.2 | 5.3 | 3.9 |
| 1.0 | 60.2 | 12.0 | 8.7 |

TABLE 13-continued

| Filtration Performance of GSB70 Media (% Cleanup) | | | |
|---|---|---|---|
| Time (minutes) | GSB70 Charged/ Moving | GSB70 Uncharged/ Moving | GSB70 Uncharged/ Static |
| 1.5 | 83.8 | 19.8 | 14.4 |
| 2.0 | 93.7 | 28.2 | 20.0 |
| 2.5 | 97.4 | 36.9 | 25.9 |
| 3.0 | 98.9 | 45.1 | 32.2 |
| 3.5 | 99.4 | 52.6 | 38.2 |
| 4.0 | 99.6 | 60.2 | 44.7 |
| 4.5 | 99.7 | 66.5 | 50.2 |
| 5.0 | 99.8 | 71.4 | 55.4 |
| 5.5 | 99.7 | 76.0 | 60.4 |
| 6.0 | 99.8 | 80.1 | 65.0 |
| 6.5 | 99.8 | 83.2 | 68.9 |
| 7.0 | 99.8 | 86.2 | 72.8 |
| 7.5 | 99.8 | 88.5 | 76.0 |
| 8.0 | 99.8 | 90.5 | 79.1 |
| 8.5 | 99.8 | 91.9 | 81.4 |
| 9.0 | 99.8 | 93.1 | 84.0 |
| 9.5 | 99.7 | 94.2 | 86.1 |
| 10.0 | 99.7 | 95.0 | 87.6 |
| CADR ($m^3$/h) | 87.7 | 17.9 | 11.7 |

TABLE 14

| Filtration Performance of Meltblown Media (% Cleanup) | | | |
|---|---|---|---|
| Time (minutes) | Meltblown Charged/ Moving | Meltblown Uncharged/ Moving | Meltblown Charged/ Static |
| 0 | 0 | 0 | 0 |
| 0.5 | 16.6 | 6.5 | 6.2 |
| 1.0 | 42.4 | 15.4 | 14.2 |
| 1.5 | 65.5 | 26.3 | 24.0 |
| 2.0 | 81.1 | 37.4 | 34.2 |
| 2.5 | 90.2 | 48.5 | 44.6 |
| 3.0 | 94.5 | 58.9 | 53.8 |
| 3.5 | 97.0 | 67.7 | 62.8 |
| 4.0 | 98.1 | 75.2 | 70.0 |
| 4.5 | 98.8 | 81.1 | 76.0 |
| 5.0 | 99.2 | 85.5 | 81.1 |
| 5.5 | 99.3 | 89.0 | 85.2 |
| 6.0 | 99.5 | 91.6 | 88.2 |
| 6.5 | 99.5 | 93.6 | 90.6 |
| 7.0 | 99.5 | 95.0 | 92.3 |
| 7.5 | 99.5 | 96.0 | 93.8 |
| 8.0 | 99.6 | 96.9 | 94.9 |
| 8.5 | 99.6 | 97.5 | 95.8 |
| 9.0 | 99.6 | 98.0 | 96.4 |
| 9.5 | 99.6 | 98.4 | 96.9 |
| 10.0 | 99.5 | 98.6 | 97.3 |
| CADR ($m^3$/h) | 62.3 | 27.0 | 22.7 |

Examination of the data in TABLES 11–14 clearly demonstrates that all four media studied can remove a particulate challenge more rapidly in a moving configuration than in a static configuration and that this relative performance advantage is realized whether the media is charged or uncharged. Optimum particle removal performance for all four media was realized when the media was charged.

EXAMPLE 10

The impact of various filter constructions on the airflow through the Automotive HVAC test configuration (described above) was studied by mounting the filter constructions inside the blower wheel and monitoring the airflow through the system at various operating speeds.

Filter constructions studied included a GSB70 particulate filter having slit pleat tips (with OD of 12.38 cm, an ID of 10.48 cm, and a height of 5.4 cm, prepared as described above, with 55 pleats at a pleat spacing of 6 mm, each pleat being 10 mm in height and made from the indicated filter media), a GSB70 particulate filter having holes punched through the media (same filter construction as the above filter) to produce a 20% open area, a combination filter consisting of Kuraray 7400-BN (a nonwoven web loaded with activated coconut based carbon particles, 400 g/$m^2$, available from Kuraray, Inc.) sandwiched between a GSB-30 web on one side and a Reemay 2004 web (a spunbond polyester web, available from Reemay Inc., Old Hickory, Tenn.) on the other side, a molded agglomerated carbon cylinder having no holes, a molded agglomerated carbon cylinder having 84 holes (6.4 mm in diameter) to produce a 12% open area relative to the total filter area (described above), and a molded agglomerated carbon cylinder having 90 holes (7.5 mm in diameter) to produce a 20% open area relative to the total filter area (prepared similar to the 12% open area filter except having a greater number of holes).

The GSB70 filter with holes (20% open area) was prepared in substantially the same manner as the slit pleat tip filter except that 9 square holes (5 mm each) per 4 $cm^2$ were punched into the GSB70 media prior to pleating and the pleat tips were not slit.

Each filter construction was mounted in the Automotive HVAC Configuration test apparatus (full dash unit), the unit operated at the voltages indicated in TABLE 15, and the airflow through the system determined for the various operating voltages. Airflow data for the various filter configurations are reported in TABLE 15.

TABLE 15

| Airflow vs. Filter Construction (cubic meters/hour) | | | | |
|---|---|---|---|---|
| | Motor Operating Voltage | | | |
| Filter Type | 4.5 | 6.0 | 9.0 | 13.0 |
| No Filter | 183 | 233 | 319 | 423 |
| GSB70 w/Slit Tips | 141 | 189 | 282 | 364 |
| GSB70 w/Holes (20%) | 144 | 185 | 260 | 360 |
| Combi-Web w/Slit Tips (20.5 grams) | 109 | 139 | 207 | 289 |
| Molded Carbon - No Holes (110 grams) | 88 | 107 | 163 | 223 |
| Molded Carbon w/Holes 12% Open (94 grams) | 131 | 180 | 251 | 335 |
| Molded Carbon w/Holes 20% Open (83.5 grams) | 138 | 183 | 255 | 340 |

The data presented in TABLE 15 demonstrate that it is possible to incorporate higher sorptive capacity filter constructions (i.e. molded carbon agglomerate filter constructions) according to the present invention into an automotive HVAC system with a minimal negative impact on the airflow characteristics of the system.

EXAMPLE 11

Gas and vapor removal performance of two identical molded carbon agglomerate constructions (about 12% open area, prepared as described above) in "moving" and "static" configurations were studied using the Time to Cleanup (Vapor Challenge) test described above, replacing the mini-turbo fan unit with the Automotive HVAC Configuration—second configuration. In this study the filter elements were placed inside the blower wheel and the Automotive HVAC unit was operated at about 4.5 and about 9 volts.

The "moving" filter cartridge was mounted directly onto the blower wheel. The "static" filter was positioned just off the surface of the blower wheel by mounting it to the stationary scroll housing such that it did not contact the blower wheel in operation. Vapor concentration data for these studies are reported in TABLE 16.

TABLE 16

Molded Carbon Agglomerate Filter "Moving" vs. "Static" Vapor Removal Performance (% Cleanup)

| Time (min.) | 9 Volt Moving | 9 Volt Static | 4.5 Volt Moving | 4.5 Volt Static |
|---|---|---|---|---|
| 0 | 79.8 | 79.9 | 80.03 | 79.65 |
| 0.167 | 70.83 | 73.15 | 75.44 | 75.05 |
| 0.333 | 59.59 | 62.27 | 68.12 | 68.57 |
| 0.5 | 49.08 | 51.42 | 61.28 | 63.16 |
| 0.667 | 40.03 | 41.98 | 54.81 | 57.73 |
| 0.833 | 32.16 | 34.15 | 49.61 | 53.20 |
| 1.00 | 25.57 | 27.94 | 44.27 | 48.80 |
| 1.167 | 20.78 | 22.45 | 39.41 | 45.23 |
| 1.333 | 16.56 | 18.50 | 35.10 | 41.40 |
| 1.50 | 13.37 | 14.99 | 31.49 | 38.32 |
| 1.667 | 10.89 | 12.32 | 27.99 | 35.25 |
| 1.833 | 8.97 | 10.16 | 24.96 | 32.49 |
| 2.00 | 7.52 | 8.47 | 22.29 | 30.01 |
| 2.167 | 6.27 | 6.97 | 20.16 | 27.80 |
| 2.333 | 5.08 | 5.93 | 18.01 | 25.46 |
| 2.50 | 4.41 | 5.15 | 16.11 | 23.75 |
| 2.667 | 3.95 | 4.51 | 14.54 | 22.00 |
| 2.883 | 3.30 | 3.96 | 13.20 | 20.33 |
| 3.00 | 2.94 | 3.46 | 11.94 | 18.73 |
| 3.167 | 2.51 | 3.08 | 10.84 | 17.55 |
| 3.333 | 2.34 | 2.92 | 9.85 | 16.24 |
| 3.50 | 2.00 | 2.57 | 9.04 | 15.13 |
| 3.667 | 1.85 | 2.46 | 8.12 | 14.03 |
| 3.833 | 1.75 | 2.34 | 7.57 | 13.07 |
| 4.00 | 1.64 | 2.17 | 6.83 | 12.16 |
| 4.167 | 1.57 | 2.13 | 6.43 | 10.63 |
| 4.333 | 1.43 | 1.98 | 5.98 | 10.67 |
| 4.50 | 1.55 | 1.94 | 5.40 | 10.01 |
| 4.667 | 1.52 | 1.83 | 5.02 | 9.30 |
| 4.833 | 1.39 | 1.81 | — | — |
| 5.00 | 1.22 | 1.83 | — | — |

While both the "moving" and "static" filter configurations eventually reached similar particle concentrations in the test apparatus, it is apparent from an examination of the data in TABLE 16 that the "moving" filter configuration was able to reduce the vapor concentration more rapidly than the "static" filter.

The complete disclosures of all patents, patent applications, and publications are incorporated herein by reference as if individually incorporated. Various modifications and alterations of this invention will become apparent to those skilled in the art without departing from the scope and spirit of this invention, and it should be understood that this invention is not to be unduly limited to the illustrative embodiments set forth herein.

What is claimed is:

1. A filtration system that rotates in conjunction with a blower wheel, the blower wheel having a plurality of fan blades arranged in a spaced relationship radially around a blower cavity to define a flow path extending radially outward from the blower cavity through the fan blades when the blower wheel is rotating, the filtration system comprising:

a filter cartridge releasably attachable to the blower wheel in an engaged configuration, the filter cartridge comprising a porous filter medium defining a generally center opening and a filter surface configured to be generally adjacent to the fan blades and to extend across at least a portion of the flow path when in the engaged configuration; and a plurality of unimpeded air flow passages extending through the filter cartridge which air flow passages permit airflow even when the filter medium is fully loaded.

2. The system of claim 1 wherein the filter surface comprises an outer filter surface configured to be adjacent to an inner surface defined by the fan blades.

3. The system of claim 1 wherein the filter surface comprises an inner filter surface configured to be adjacent to an outer surface defined by the fan blades.

4. The system of claim 1 wherein the filter cartridge comprises a filter media having a Frazier permeability of at least 2000 $m^3/hr/m^2$.

5. The system of claim 1 wherein the filter medium is selected from a group consisting of electret charged medium, particulate medium, sorbent medium or combinations thereof.

6. The system of claim 1 wherein the filter medium comprises a plurality of pleats having pleat tips generally parallel to the filter surface, the pleat tips comprising a plurality of slits.

7. The system of claim 6 wherein the plurality of slits are generally parallel to the pleat tips.

8. The system of claim 1 wherein the filter medium comprises a plurality of filter elements extending generally radially outward from the center opening in a spaced relationship.

9. The system of claim 1 wherein the flow passages comprise a plurality of holes through the filter medium.

10. The system of claim 1 wherein the filter cartridge comprises:

a plurality of annular filter elements stacked to define the filter surface; and at least one retaining structure to maintain the annular filter elements in a generally concentric configuration.

11. The system of claim 10 further comprising a plurality of spacers positioned between at least two of the annular filter elements.

12. The system of claim 10 further comprising radial pleats in at least one of the annular filter elements.

13. The system of claim 10 further comprising embossed portions on at least one of the annular filter elements.

14. The system of claim 1 further comprises at least one fastener for releasably retaining the filter cartridge to the blower wheel.

15. The system of claim 14 wherein the fastener is selected from a group consisting of hook and loop fasteners, pressure sensitive adhesives, clips, and retaining tabs.

16. The system of claim 1 wherein the filter cartridge further comprises a support structure having a general shape corresponding to the blower wheel.

17. The system of claim 1 wherein the filter cartridge comprises a height selected from a height greater than, less than or equal to a height of the blower wheel.

18. The system of claim 1 wherein the filter surface extends substantially across the entire flow path when in the engaged configuration.

19. The system of claim 1 wherein the filter surface comprises a generally cylindrical shape.

20. The system of claim 1 wherein the center opening comprises a generally cylindrical shape.

21. An HVAC system comprising an outside air inlet and outlet and conduit containing the blower wheel and filtration system of claim 1.

22. An air purifying system comprising a housing having an air inlet and outlet containing the blower wheel and filtration system of claim 1.

23. A filtration system that rotates in conjunction with a blower wheel, the blower wheel having a plurality of fan blades arranged in a spaced relationship radially around a blower cavity to define a flow path extending radially outward from the blower cavity through the fan blades when the blower wheel is rotating, the filtration system comprising:

a filter cartridge releasably attachable to the blower wheel in an engaged configuration, the filter cartridge comprising a plurality of annular filter elements stacked to define a filter surface configured to be generally adjacent to the fan blades and to extend across at least a portion of the flow path when in the engaged configuration; and at least one retaining clip to retain the plurality of annular filter elements to the filter cartridge.

24. The filtration system of claim 23 further comprising a plurality of flow passages extending through the filter cartridge.

25. A filter cartridge comprising:

a plurality of porous, discrete annular filter elements having substantially the same shape stacked concentrically to define an outer filter surface and an inner filter surface; and at least one retaining structure maintaining a generally concentric alignment of the annular filter elements in the filter cartridge wherein the discrete annular filter elements are arranged to have unimpeded flowpaths between the filter elements which flowpaths extend between the outer filter surface and the inner filter surface.

26. The filter cartridge of claim 25 further comprising a plurality of spacers positioned between at least two of the annular filter elements.

27. The filter cartridge of claim 26 wherein the spacers comprise radial pleats in at least one of the annular filter elements.

28. The filter cartridge of claim 26 wherein the spacers comprise embossed portions of at least one of the annular filter elements.

29. The filter cartridge of claim 25 wherein the retaining structure comprises means for releasably attaching the filter element to a blower wheel.

* * * * *